US007873301B2

(12) United States Patent
Ishii

(10) Patent No.: US 7,873,301 B2
(45) Date of Patent: Jan. 18, 2011

(54) IMAGE FORMING APPARATUS HAVING A REMOVABLE PHOTOSENSITIVE MEMBER UNIT

(75) Inventor: Makoto Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/618,420

(22) Filed: Nov. 13, 2009

(65) Prior Publication Data

US 2010/0054811 A1 Mar. 4, 2010

Related U.S. Application Data

(63) Continuation of application No. 11/692,342, filed on Mar. 28, 2007, now Pat. No. 7,636,531.

(30) Foreign Application Priority Data

Mar. 30, 2006 (JP) ..... 2006-095210

(51) Int. Cl.
*G03G 21/18* (2006.01)

(52) U.S. Cl. ..... 399/111

(58) Field of Classification Search ..... 399/111
See application file for complete search history.

(56) References Cited

U.S. PATENT DOCUMENTS 6,101,349 A 8/2000 Ohashi et al.
6,708,011 B2 3/2004 Yujiro et al.
2006/0067734 A1 3/2006 Igarashi et al.
2007/0053716 A1 3/2007 Itabashi
2007/0071494 A1 3/2007 Igarashi et al.

FOREIGN PATENT DOCUMENTS

JP 4-184360 A 7/1992
JP 5-257340 A 10/1993
JP 2003-015378 A 1/2003
JP 2005-037633 A 2/2005

OTHER PUBLICATIONS

JP Office Action dtd Sep. 28, 2010, JP Appln. 2006-095210, partial English Translation.

*Primary Examiner*—David M Gray
*Assistant Examiner*—Andrew V Do
(74) *Attorney, Agent, or Firm*—Banner & Witcoff, Ltd

(57) ABSTRACT

An image forming apparatus can include a body casing, a photosensitive member unit configured to be inserted into and withdrawn from the body casing, the photosensitive member unit can be moved between a first position where the photosensitive member unit is stored in the body casing and a second position where the photosensitive member unit is withdrawn from the body casing, and between the second position and a third position where the photosensitive member unit is withdrawn from the body casing. The image forming apparatus may further include a control member disposed in the body casing, the control member configured to move between a holding position in which the photosensitive member unit is prevented from moving between the second position and the third position and a release position where the photosensitive member unit is allowed to move between the second position and the third position.

12 Claims, 17 Drawing Sheets

IMAGE FORMING APPARATUS HAVING A REMOVABLE PHOTOSENSITIVE MEMBER UNIT

CROSS REFERENCE TO RELATED APPLICATION

This application is a continuation of prior U.S. application Ser. No. 11/692,342, filed Mar. 28, 2007, which claims priority from Japanese Patent Application No. 2006-095210, filed on Mar. 30, 2006, the entire subject matter of which is incorporated herein by reference.

FIELD OF THE INVENTION

Illustrative aspects of the invention relate to an image forming apparatus such as a laser printer.

BACKGROUND

A known color image forming apparatus, such as a color laser printer, is provided with a photosensitive member cartridge including four photosensitive drums, corona dischargers and cleaning devices, which are disposed around the photosensitive drums. The photosensitive member cartridge is configured to be attached to and removed from a main body of the image forming apparatus.

In the image forming apparatus, the photosensitive member cartridge is provided on its frame with the four photosensitive members and their appendixes, i.e., the corona chargers and cleaning devices while they are relatively positioned. A pair of fixing rollers and a pair of ejecting rollers are mounted on a side plate that can turn concentrically with respect to the center of rotation of the follower roller. The side plate is turned, and the pair of fixing rollers and the pair of ejecting rollers are retracted, thereby defining an opening through which the photosensitive member cartridge is withdrawn out of the system. In the state where the photosensitive member cartridge has been withdrawn from the main body, the photosensitive member cartridge can be detached from the system and replaced by a new photosensitive member cartridge.

In the color image forming apparatus, the photosensitive member cartridge can be temporarily placed on the side plate previously turned when it is withdrawn from the main body. Thus, the user can change his/her grip on the withdrawn photosensitive member cartridge on the side plate and remove the cartridge.

However, for a size reduction of the apparatus, the side plate on which the photosensitive member cartridge is placed may be omitted or may be reduced in strength to such a degree that it cannot support the photosensitive member cartridge. In such configurations, the photosensitive member cartridge needs to be pulled out and immediately removed from the main body. In addition, as it is hard for the user to change his/her grip on the withdrawn photosensitive member cartridge, attaching and removing the photosensitive member cartridge may become difficult.

SUMMARY

Illustrative aspects of the invention can provide an image forming apparatus that can achieve a reduction in size and enable a photosensitive member unit to be removed from a body casing.

According to an aspect, an image forming apparatus includes a body casing, a photosensitive member unit configured to be inserted into and withdrawn from the body casing, the photosensitive member unit configured to move between a first position where the photosensitive member unit is stored in the body casing, and a second position where the photosensitive member unit is withdrawn from the body casing, the photosensitive member unit configured to move between the second position and a third position where the photosensitive member unit is withdrawn from the body casing, the photosensitive member unit configured to hold a photosensitive members. The image forming apparatus further includes a control member disposed in the body casing, the control member configured to move between a holding position in which the photosensitive member unit is prevented from moving between the first position and the third position and a release position where the photosensitive member unit is allowed to move between the second position and the third position.

BRIEF DESCRIPTION OF THE DRAWINGS

Illustrative aspects of the invention will be described in detail with reference to the following figures in which like elements are labeled with like numbers and in which.

DETAILED DESCRIPTION

Illustrative aspects of the invention will be described in detail with reference to the accompanying drawings.

First, the general structure of an illustrative color laser printer 1 will be described below.

Figure 1:
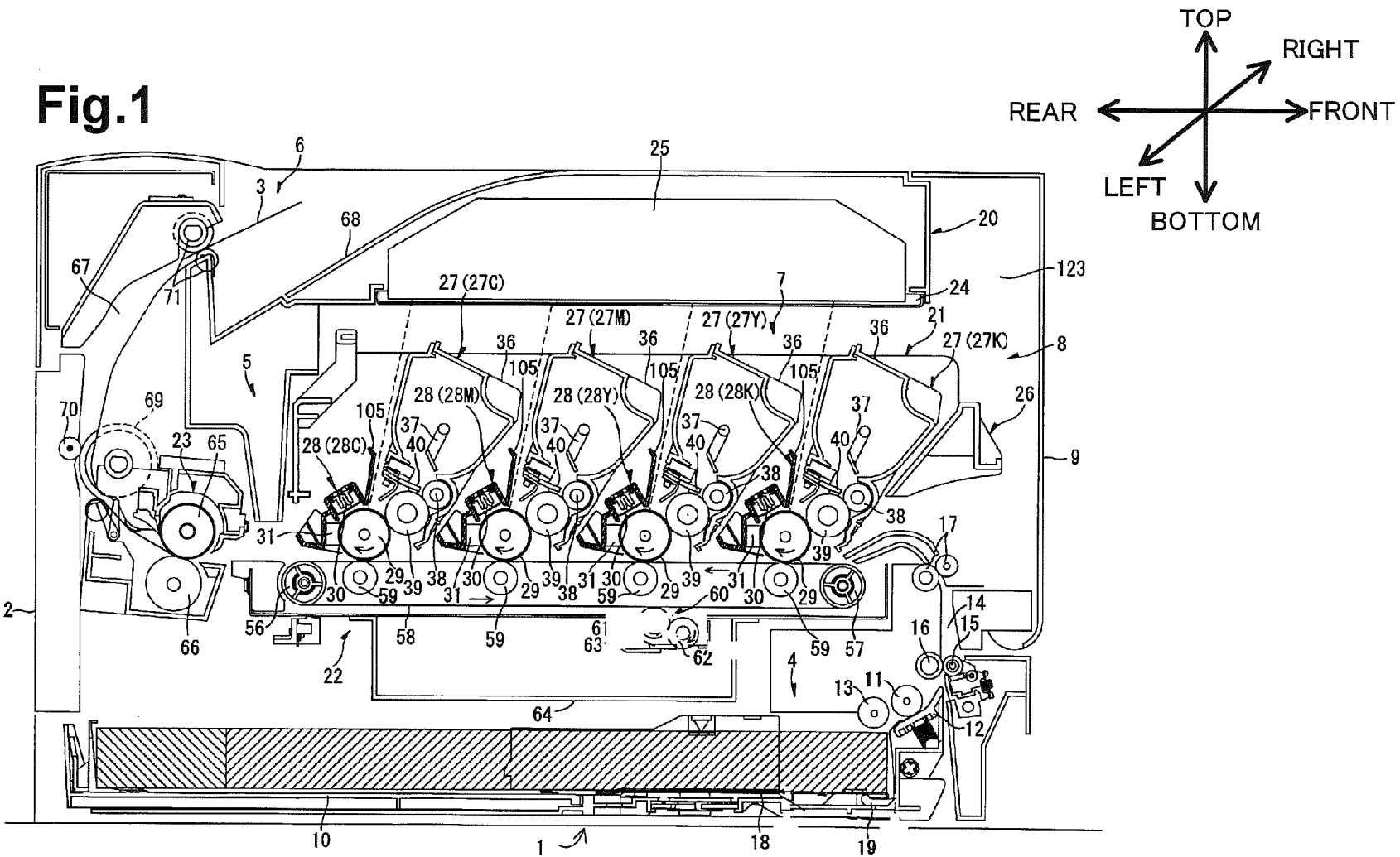
FIG. 1 is a left-side sectional view of a color laser printer as an image forming apparatus according to illustrative aspects of the invention.

In FIG. 1, the color laser printer 1 is a tandem color laser printer in which drum sub units 28 are arranged in tandem in a horizontal direction. The color laser printer 1 includes, in a body casing 2, a sheet supply section 4 that supplies a sheet 3, an image forming section 5 that forms an image on the sheet 3 fed therein, and a sheet ejection section 6 that ejects the sheet 3 on which the image is formed.

In the following description, the right side in FIG. 1 is referred to as the front side of the printer 1, and an opposite side (the left side in FIG. 1) is referred to as the rear side of the printer 1, as shown in arrows in FIG. 1. The right and left sides of the printer 1 are defined when the printer 1 is viewed from the front side. More specifically, the left and right sides of the printer 1 are front and rear sides, respectively, in a direction perpendicular to the sheet of FIG. 1. The left-right direction may be referred to as a width direction.

The body casing 2 is substantially box shaped in side view. The body casing 2 has a drum accommodating space 7 for accommodating a drum unit 26, which will be described in detail below.

An opening 8 that communicates with the drum accommodating space 7 is provided at the front side of the body casing 2. A front cover 9 to cover or uncover the opening 8 is disposed at the front side. The front cover 9 is configured that it is inclined frontward of the body casing 2 to uncover the opening 8, and it is in an upright position along the front face of the body casing 2 to cover the opening 8. With the opening 8 being uncovered, the drum unit 26 can be inserted in or removed from the drum accommodating space 7 through the opening 8.

The sheet supply section 4 is provided at a bottom portion of the body casing 2. The sheet supply section 4 includes a sheet supply tray 10, a separation roller 11, a separation pad 12, a pickup roller 13, and a sheet supply path 14. The sheet supply tray 10 holds sheets 3 therein. The separation roller 11 and the separation pad 12 are disposed at the upper front end of the sheet supply tray 10 to face each other. The pickup roller 13 is disposed behind the separation roller 11. The sheets 3 are fed along the sheet supply path 14.

The sheet supply path 14 is substantially U shaped in a side view. An upstream end of the sheet supply path 14 in a sheet feeding direction is disposed near the separation roller 11. A downstream end of the sheet supply path 14 is disposed near a front side of a conveyor belt 58 (described below). A sheet dust removing roller 15 and a pinch roller 16 facing each other are disposed in front of and above the separation roller 11 in the sheet supply path 14. A pair of register rollers 17 is disposed above the sheet dust removing roller 15 and the pinch roller 16.

The image forming section 5 includes a scanner unit 20, a process unit 21, a transfer unit 22, and a fixing unit 23.

The scanner unit 20 is disposed in an upper portion of the body casing 2. The scanner unit 20 includes a support plate 24 extending in the front-rear and right-left directions, and an exposure unit 25 fixed on the upper surface of the support plate 24.

The process unit 21 is disposed below the scanner unit 20 and above the sheet supply section 4. The process unit 21 includes a drum unit 26, functioning as a photosensitive member unit, and four developing cartridges 27 for each color, functioning as developer supply units.

The drum unit 26 includes four drum sub units 28. That is, the drum sub units 28 include a black drum sub unit 28K, a yellow drum sub unit 28Y, a magenta drum sub unit 28M, and a cyan drum sub unit 28C.

The drum sub units 28 are arranged in a row with some distance between adjacent drum sub units 28 in the front-rear direction. More specifically, the black drum sub unit 28K, the yellow drum sub unit 28Y, the magenta drum sub unit 28M, and the cyan drum sub unit 28C, are arranged in this order from the front to the rear.

Each drum sub unit 28 includes a pair of side frames 104 and a center frame 105 disposed between the side frames 104. (Refer to FIG. 4.)

Figure 2:
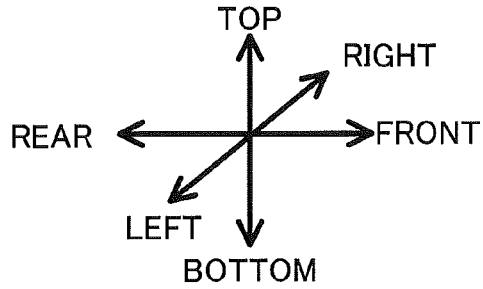
FIG. 2 is a left-side sectional view of a developing cartridge and a drum sub unit.
Figure 2:
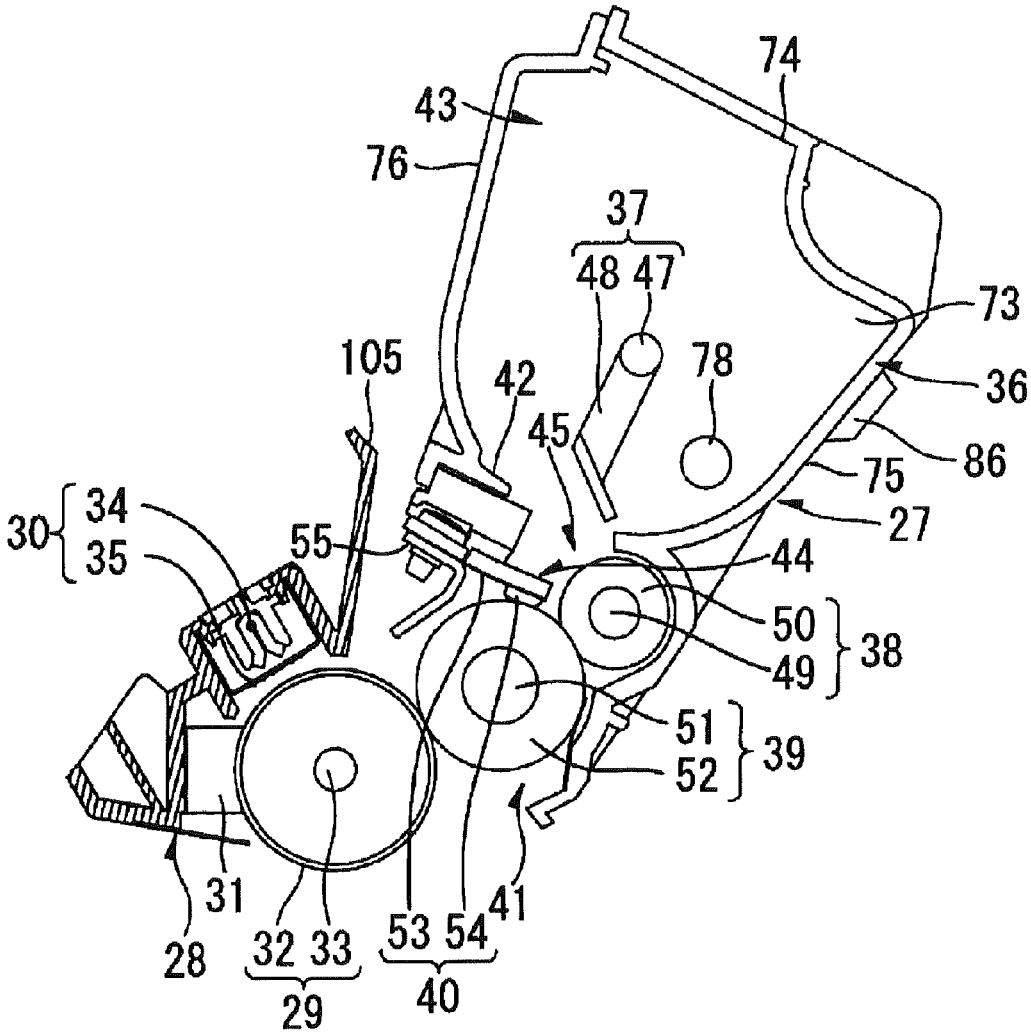

As shown in FIG. 2, each drum sub unit 28 holds a photosensitive drum 29, functioning as a photosensitive member, a scorotron charger 30, and a cleaning brush 31.

Figure 4:
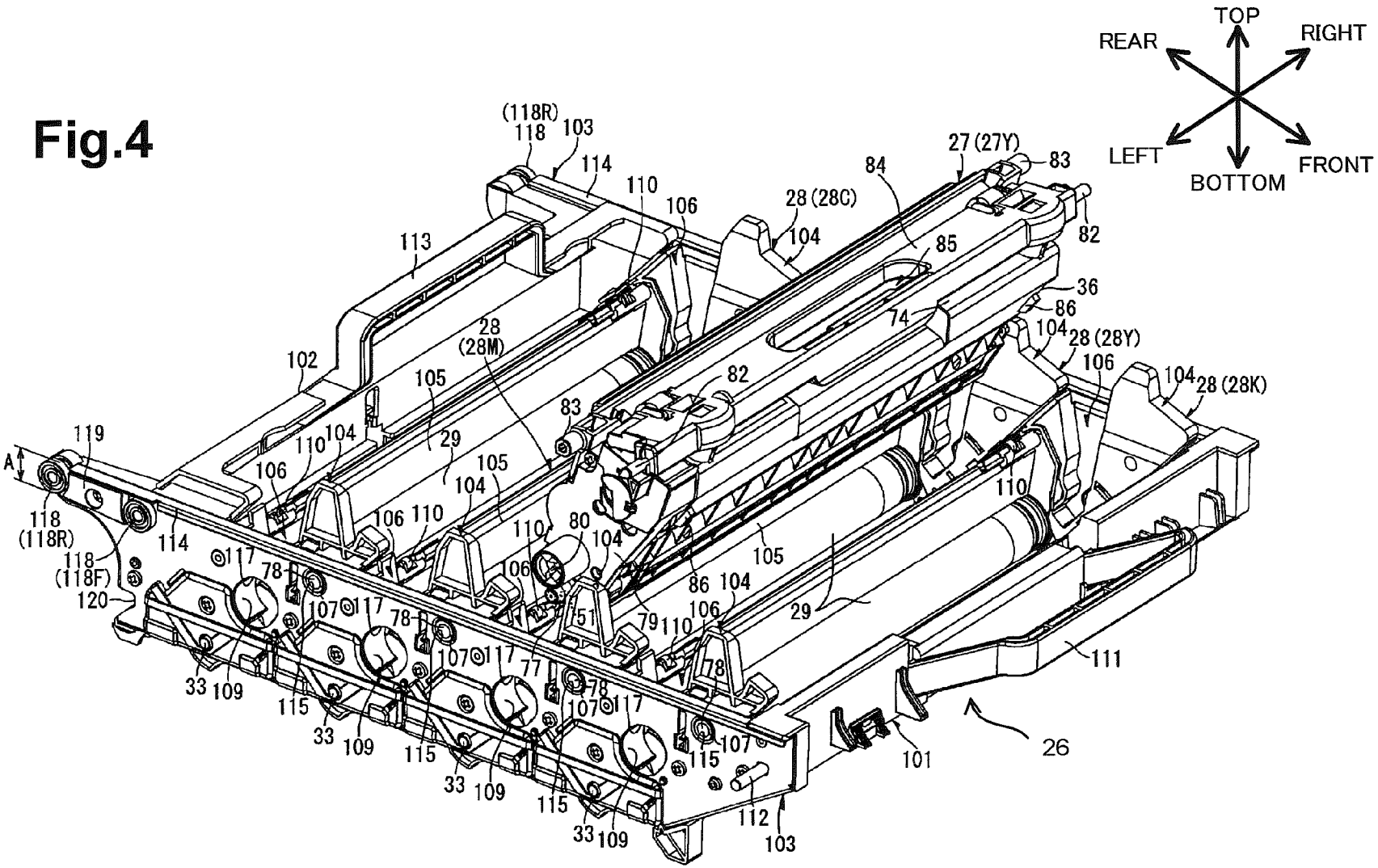
FIG. 4 is a perspective view of the drum unit viewed from an upper front left side, wherein one developing cartridge is being removed from the drum unit, and other developing cartridges are removed from the drum unit.

The photosensitive drum 29 includes a drum body 32 and a drum shaft 33. The drum body 32 extends along the right-left direction and has a cylindrical shape. The outermost layer of the drum body 32 is coated with a positively charged photosensitive layer formed from polycarbonate. The drum shaft 33 is disposed along an axial direction of the drum body 33. The drum body 32 is rotatably supported by the drum shaft 33. The drum shaft 33 is inserted into the pair of side frames 104 (FIG. 4) and is supported by a pair of side plates 103 (FIG. 4).

The scorotron charger 30 is disposed behind and diagonally above the photosensitive drum 29 to face the photosensitive drum 29. The scorotron charger 30 is held by the center frame 105. The scorotron charger 30 includes a charging wire 34 and a grid 35. The scorotron charger 30 is configured to positively and uniformly charge the surface of the photosensitive drum 29 while controlling the amount of charge applied to the photosensitive drum 29.

The cleaning brush 31 is disposed in contact with the photosensitive drum 29 to remove paper dust or fibers on the photosensitive drum 29. The cleaning brush 31 is supported by the center frame 105.

The four developing cartridges 27 are configured to be detachably mounted in the corresponding drum sub units 28 provided for each color, as shown in FIG. 1. That is, the developing cartridges 27 includes a black developing cartridge 27K detachably mountable in the black drum sub unit 28K, a yellow developing cartridge 27Y detachably mountable in the yellow drum sub unit 28Y, a magenta developing cartridge 27M detachably mountable in the magenta drum sub unit 28M, and a cyan developing cartridge 27C detachably mountable in the cyan drum sub unit 28C.

As shown in FIG. 2, each developing cartridge 27 includes a developing frame 36, and an agitator 37, a supply roller 38, a developing roller 39, functioning as a developer carrier, and a layer thickness regulating blade 40 that are disposed in the developing frame 36.

The black developing cartridge 27K contains black toner, the yellow developing cartridge 27Y contains yellow toner, the magenta developing cartridge 27M contains magenta toner, and the cyan developing cartridge 27C contains cyan toner. Each developing cartridge 27 contains, for example, positively chargeable non-magnetic single component polymerized toner.

The transfer unit 22 is disposed above the sheet supply section 4 and below the process unit 21 in the body casing 2, along the front-rear direction, as shown in FIG. 1. The transfer unit 22 includes a drive roller 56, a driven roller 57, a conveyor belt 58, transfer rollers 59, and a cleaning unit 60.

The sheet 3 supplied from the sheet supply section 4 is fed from the front to the rear by the conveyor belt 58, which is circulated by the drive roller 56 and the driven roller 57, so as to sequentially pass transfer positions between the conveyor belt 58 and the photosensitive drums 29 of the drum sub units 28. While the sheet 3 is being fed, each of the different colored toner images carried on the photosensitive drums 29 of the drum sub units 28 are sequentially transferred on top of each other on the sheet 3. Thus, a multi-color image is formed on the sheet 3.

More specifically, when a black toner image carried on the photosensitive drum 29 of the black drum sub unit 28K is transferred to the sheet 3, a yellow toner image formed on the photosensitive drum 29 of the yellow drum sub unit 28Y is then transferred onto the sheet 3 having the black toner image transferred thereon. Similarly, a magenta toner image formed on the photosensitive drum 29 of the magenta drum sub unit 28M and a cyan toner image formed on the photosensitive drum 29 of the cyan drum sub unit 28C are transferred and laid on top of each other on the sheet 3. Thus, a multi-color image is formed on the sheet 3.

In the cleaning unit 60, during the above toner image transfer, toner adhering to the surface of the conveyor belt 58 is transferred to a first cleaning roller 61 and then a second cleaning roller 62. The toner transferred to the second cleaning roller 62 is scraped off by a scraper blade 63, and is stored in a toner storing portion 64.

The fixing unit 23 is disposed behind the black drum sub unit 28K in the body casing 2 to face, in the front-rear direction, the transfer position between photosensitive drum 29 and the conveyor belt 58. The fixing unit 23 includes a heat roller 65 and a pressure roller 66.

The sheet 3 is fed to the fixing unit 23 where the color toner image transferred on the sheet 3 is thermally fixed while the sheet 3 passes between the heat roller 65 and the pressure roller 66.

In the sheet ejection section 6, the sheet 3 is fed from the fixing unit 23 along a sheet ejection path 67 to a feed roller 69 and a pinch roller 70, and ejected by ejection rollers 71 onto a sheet ejection tray 68.

The drum unit 26 will be described below.

Figure 3:
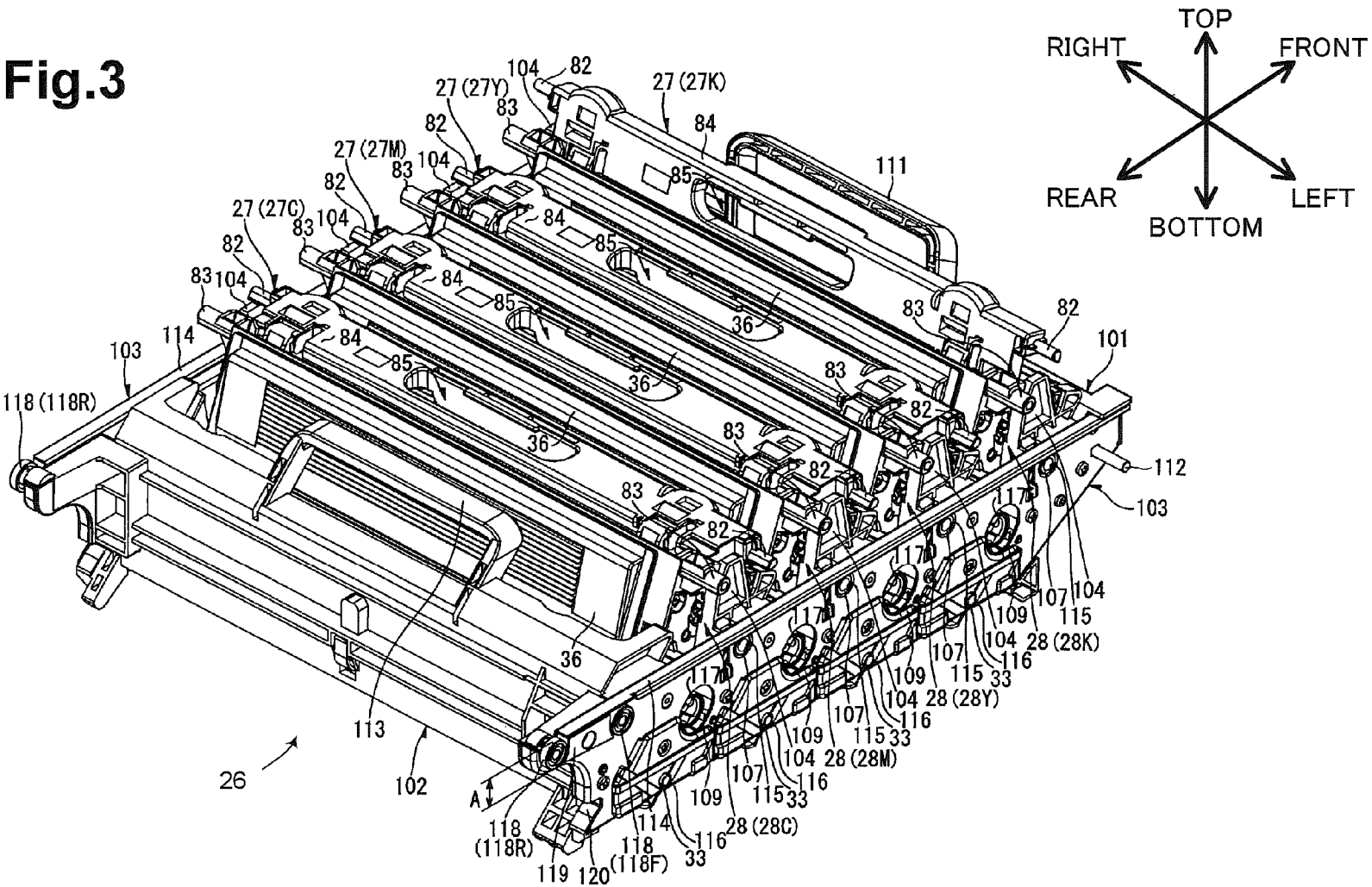
FIG. 3 is a perspective view of a drum unit viewed from an upper rear left side, wherein four developing cartridges are installed.

As shown in FIG. 3, the drum unit 26 includes four drum sub units 28 for the four colors, a front beam 101 and a rear beam 102, which are disposed in front of and behind the four drum sub unit 28, respectively, and a pair of side plates 103 that sandwich the front beam 101, the four drum sub units 28, and the rear beam 102 from each side in a width direction of the drum unit 26.

The drum unit 26 is configured to be slidably installed in or removed from the drum accommodating space 7 (FIG. 1) in the body casing 2 together with the four drum sub unit 28, the front beam 101, the rear beam 102, and the pair of side plates 103 of the drum unit 26.

As shown in FIG. 4, each drum sub unit 28 includes a pair of side frames 104 disposed to face each other with some distance therebetween in the longitudinal direction of the drum sub unit 28 (i.e., width direction of the drum unit 26/right-left direction), and a center frame 105 disposed between the side frames 104.

Each side frame 104 is formed of a resin material into a substantially flat plate-like shape. The drum shaft 33 of the photosensitive drum 29 is inserted into each side frame 104.

Each side frame 104 has a guide groove 106 for guiding the developing cartridge 27 into the corresponding drum sub unit 28. Each guide groove 106 is formed in a substantially top-bottom direction from an upper end at the rear side of the side frame 104 to a bottom end at the front side of the side frame 104. The bottom end (the deepest portion) of each guide groove 106 is provided at a position corresponding to a position of the developing roller shaft 51 when the developing roller 39 is brought into contact with the corresponding photosensitive drum 29. Each collar member 77 of the developing roller shaft 51 is slidably received in the guide groove 106.

Each side frame 104 is formed with a boss 107. The boss 107 is formed in a tubular shape and protrudes outwardly, in the width direction, from each side frame 104. The boss 107 is disposed at a position corresponding to a window 78 of the developing cartridge 27 when the developing cartridge 27 is mounted in the drum sub unit 28.

Each left side frame 104 is formed with a coupling inside insertion hole 109 at a position corresponding to a coupling passive gear 80 of the developing cartridge 27 in the width direction. The coupling inside insertion hole 109 is formed as a round hole passing through the left side frame 104 in its thickness direction.

The center frame 105 is made of a resin material. The center frame 105 is provided with support rollers 110 at both end portions in the width direction of the center frame 105. The support rollers 110 are rotatably supported to a rotating shaft (not shown) extending along the center frame 105 in the width direction.

The front beam 101 is made of a resin material as one body. The front beam 101 is disposed in front of the four drum sub units 28 arranged in the front-back direction and extended between the side plates 103.

The front beam 101 includes a front handle portion 111 functioning as a gripping portion and a support shaft 112. The front handle portion 111 is attached to the front beam 101 in the middle thereof in the width direction. The support shaft 112 is configured to rotatably support the front handle portion 111.

The front handle portion 111 is substantially U shaped, and is rotatably supported at free ends thereof to the support shaft 112. The front handle portion 111 is movable between a storage position (FIG. 3) where it stands along the front beam 101 and an operative position (FIG. 4) where it leans to front of the front beam 101.

The support shaft 112 is disposed to pass through the front beam 101 along the width direction, and is supported by the front beam 101. Both end portions of the support shaft 112 protrude outwardly from the front beam 101 and the side plates 103 in the width direction.

The rear beam 102 is made of a resin material as one body. The rear beam 102 is disposed behind the four drum sub units 28 arranged in the front-back direction, and extended between the side plates 103.

The rear beam 102 is formed in substantially an open rear box shape in a top view, and is integrally formed with a rear handle portion 113, functioning as a gripping portion, in the middle in the width direction as shown in FIG. 3. The rear handle portion 113 is substantially U shaped in a rear view, and is connected at free ends thereof to the rear beam 102. The rear handle portion 113 inclines from the lower rear side to the upper front side, and protrudes diagonally upward from the rear beam 102.

Each side plate 103 is made of a material, such as metal and fiber reinforced resin, having higher rigidity than a resin material of the front beam 101 and the rear beam 102. Each side plate 103 may be made from a thin steel plate.

Each side plate 103 is a substantially rectangular shape in a side view extending in the front-rear direction. Each side plate 103 is fixed to the front beam 101, the four drum sub units 28, and the rear beam 102, so as to face the front beam 101 at its front end and the rear beam 102 at its rear end.

Each side plate 103 is formed with a flanged portion 114, which is bent outward in the width direction from an upper end the side plate 103 so as to form a substantially L shape in a cross sectional view. The flanged portion 114 extends in a straight manner along the front-rear direction.

The rear end of each side plate 103 extends rearward at its upper portion so that it is substantially L shaped in a side view. Two roller members 118 are rotatably disposed in the upper portion of the rear end of each side plate 103 extending rearward. The two roller members 118 may be designed to have a dimension (e.g., thickness) in the width direction of the drum unit 26 substantially equal to a dimension in the width direction of the flanged portion 114, and are disposed to sandwich the spacer 119 therebetween in the front-rear direction. The front-side roller member 118F is disposed under the flanged portion 114 and the rear-side roller member 118R is disposed behind the rear end portion of the flanged portion 114. Each roller member 118 has an outer diameter defined as A. As each side plate 103 is formed in a thin plate-like shaped manner as described above, the outer diameter A of the front-side roller member 118F includes the thickness of the flanged portion 114 which is adjacent to the upper portion of the roller member 118F. In other words, a length from a bottom end of the roller member 118F to the upper end of the flanged portion 114 which is adjacent to the upper portion of the roller member 118F is defined as A.

The rear end of each side plate 103 is formed with a cutout portion 120 that is a substantially U shaped cut out in a side view. The cutout portion 120 is configured to receive a positioning shaft (not shown), which is disposed in the body casing 2, when the drum unit 26 is mounted in the body casing 2. Thus, the drum unit 26 is positioned in the body casing 2.

Each side plate 103 is formed at its upper end portion with four light transmission holes 115, which are spaced at intervals in the front-rear direction. Each light transmission hole 115 is configured to receive the boss 107 of each drum sub unit 28. Each light transmission hole 115 is formed as a round hole passing through the side plate 103 in its thickness direction at a position facing the boss 107 of the drum sub unit 28 in the width direction. The boss 107 of each drum sub unit 28 is engaged in each light transmission hole 115 so as to become exposed outwardly in the width direction. This controls the rotation of each drum sub unit 28 on the drum shaft 33 with respect to each side plate 103.

Each side plate 103 is formed at its lower end portion with shaft holes 116 in which axial ends of each drum shaft 33 are inserted.

The left side plate 103 is formed with four coupling outside insertion holes 117, which are spaced at intervals along the front-rear direction at a middle portion in the vertical direction. Each coupling outside insertion hole 117 is configured to face the coupling passive gear 80 of each developing cartridge 27 in the width direction when the developing cartridge 27 is mounted in the drum unit 26. Each coupling outside insertion hole 117 is formed as a round hole passing the side plate 103 in its thickness direction at a position facing the coupling inside insertion hole 109 of each drum sub unit 28.

A structure of each developing cartridge 27 will be described below.

Figure 5:
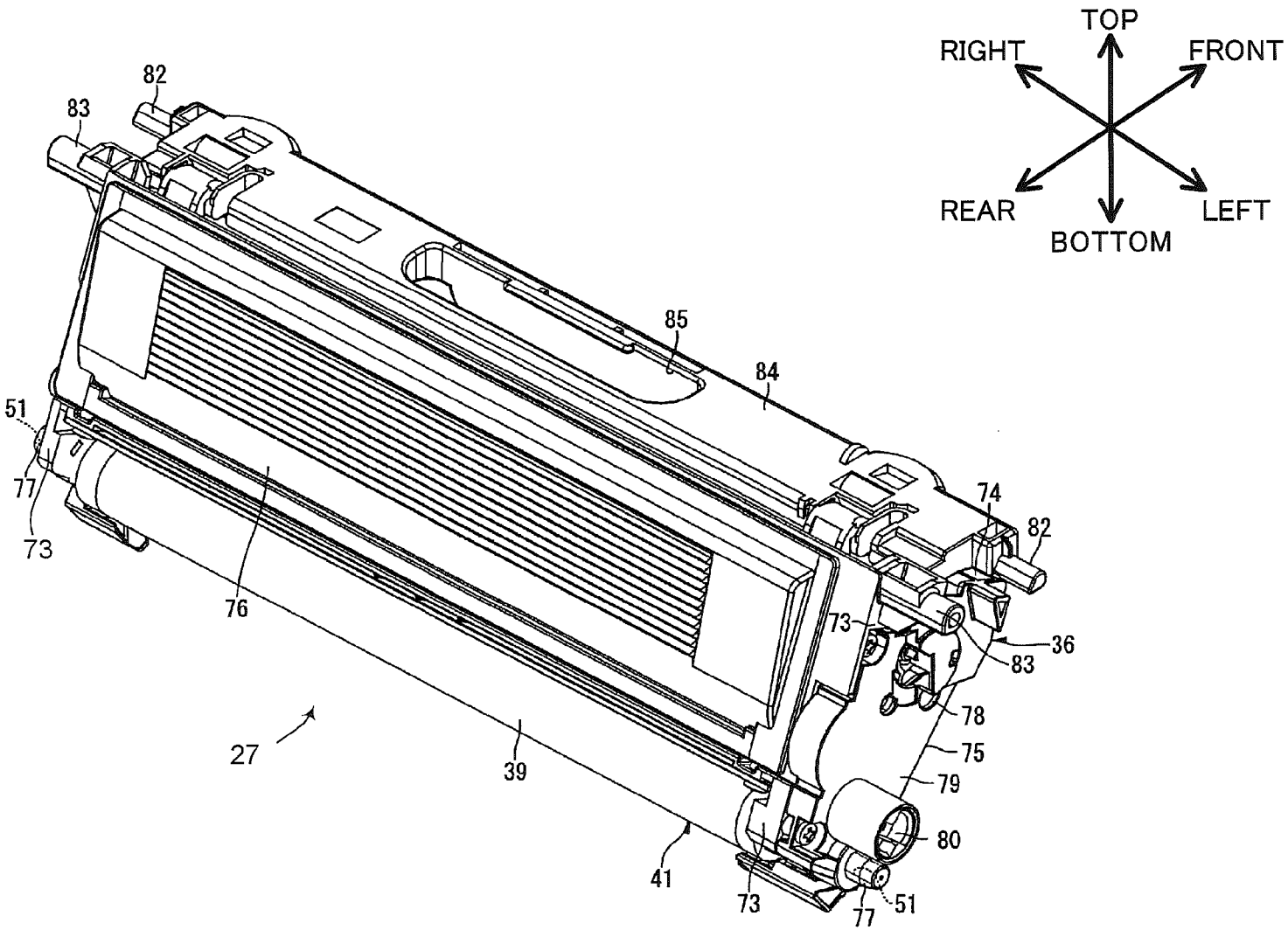
FIG. 5 is a perspective view of a developing cartridge viewed from a lower left side.

As shown in FIG. 5, the developing frame 36 of each developing cartridge 27 integrally includes a pair of sidewalls 73, a top wall 74, a front wall 75, and a rear wall 76. The top wall 74 is disposed between the sidewalls 73 at their top ends. The front wall 75 is disposed between the sidewalls 73 at their front ends. The rear wall 76 is disposed between the sidewalls 73 at their rear ends. The sidewalls 73, the front wall 75, and the rear wall 76 define the opening 41, at their bottom ends, from which the developing roller 39 is exposed.

Windows 78 for detecting the amount of toner stored in the toner chamber 43 (FIG. 2) are embedded in both sidewalls 73. The windows 78 are disposed oppositely to each other across the toner chamber 43. The windows 78 allow light to pass therethrough along the width direction for detecting the amount of toner.

The left sidewall 73 is provided with a gear mechanism (not shown) covered with a gear cover 79. The coupling passive gear 80 is disposed in the lower end portion of the gear cover 79 so as to become exposed from the outside surface of the gear cover 79.

A coupling shaft (not shown) provided in the body casing 2 is coupled to the coupling passive gear 80 so as to advance or retract and rotate together with the coupling passive gear 80. The coupling passive gear 80 receives a drive force from a motor (not shown) provided in the body casing 2 via the coupling shaft. The drive force transmitted to the coupling passive gear 80 is transmitted to the agitator 37, the supply roller 38, and the developing roller 39 via the gear mechanism.

The developing roller shaft 51 is rotatably supported in the developing frame 36. The left end of the developing roller shaft 51 protrudes outward from the gear cover 79, and the right end protrudes outward from the right side wall 73. The left end and right end of the developing roller shaft 51 are covered with collar members 77.

Both sidewalls 73 of the developing frame 36 have separation protrusions 83 in their upper rear portions. The separation protrusions 83 are formed in cylindrical hollow members protruding outward from both sidewalls 73.

The developing frame 36 is provided with a handle 84. The handle 84 is formed in a thin plate-like shape elongated in the width direction, and is disposed on the top wall 74 of the developing frame 36.

A rotating shaft (not shown) is inserted into the handle 84 at its rear end along the right-left direction. The handle 84 is pivotally supported via the rotating shaft at the rear end of the top wall 74 of the developing frame 36.

The handle 84 is formed with an elongated hole 85 having a substantially rectangular shape in the middle in the width direction. A user inserts his/her fingers into the elongated hole 85 to hold the handle 84.

The handle 84 and the top wall 74 are coupled, at their right and left ends of their front ends, with elastic members such as coil springs, plate springs, and sponges. The front end of the handle 84 is normally urged in a direction to separate from the front end of the top wall 74.

The handle 84 is formed with pressing protrusions 82 at the right and left ends of the front end. The pressing protrusions 82 protrude outwardly in the width direction.

As shown in FIG. 2, the front wall 75 is formed with a supported protrusion 86 at each of the right and left ends in the width direction. The supported protrusion 86 has a substantially trapezoidal shape in a side view, and protrudes frontward.

Installation and removal of the developing cartridge 27 from the drum unit 26 will be described below.

As shown in FIG. 4, the developing cartridge 27 for each color is inserted into the corresponding drum sub unit 28 of the drum unit 26 from above by a user who inserts his/her finger into the elongated hole 85 and holds the handle 84.

More specifically, the collar members 77 covering both ends of the developing roller shaft 51 of the developing cartridge 27 are inserted into guide grooves 106 formed in the side frames 104 of the drum sub unit 28 and the developing cartridge 27 is pressed downward in the drum sub unit 28 along the guide grooves 106. When the developing roller 39 contacts the photosensitive drum 29, the developing cartridge 27 is regulated so as not to be pressed further downward. The developing cartridge 27 tilts or pivots about the developing roller shaft 51 under its own weight in a direction that the upper end of the developing cartridge 27 leans to the adjacent center frame 105 disposed in front of the inserted developing cartridge 27. Each supported protrusion 86 formed at the front wall 75 of the developing frame 36 is brought into contact with and supported by the corresponding support roller 110 of the center frame 105. Thus, the developing cartridge 27 is installed in position in the drum sub unit 28.

When all developing cartridges 27 are installed in the corresponding drum sub units 28 as shown in FIG. 3, the front handle portion 111 of the front beam 101, the handles 84 of all developing cartridges 27, and the rear handle portion 113 of the rear beam 103 are arranged so that they overlap each other in the front-rear direction.

When a user holds and raises the handle 84 of a developing cartridge 27 installed in the drum unit 26 (the drum sub unit 28), the developing cartridge 27 can be removed from the drum unit 26.

A structure of the body casing 2 will be described below.

Figure 6:
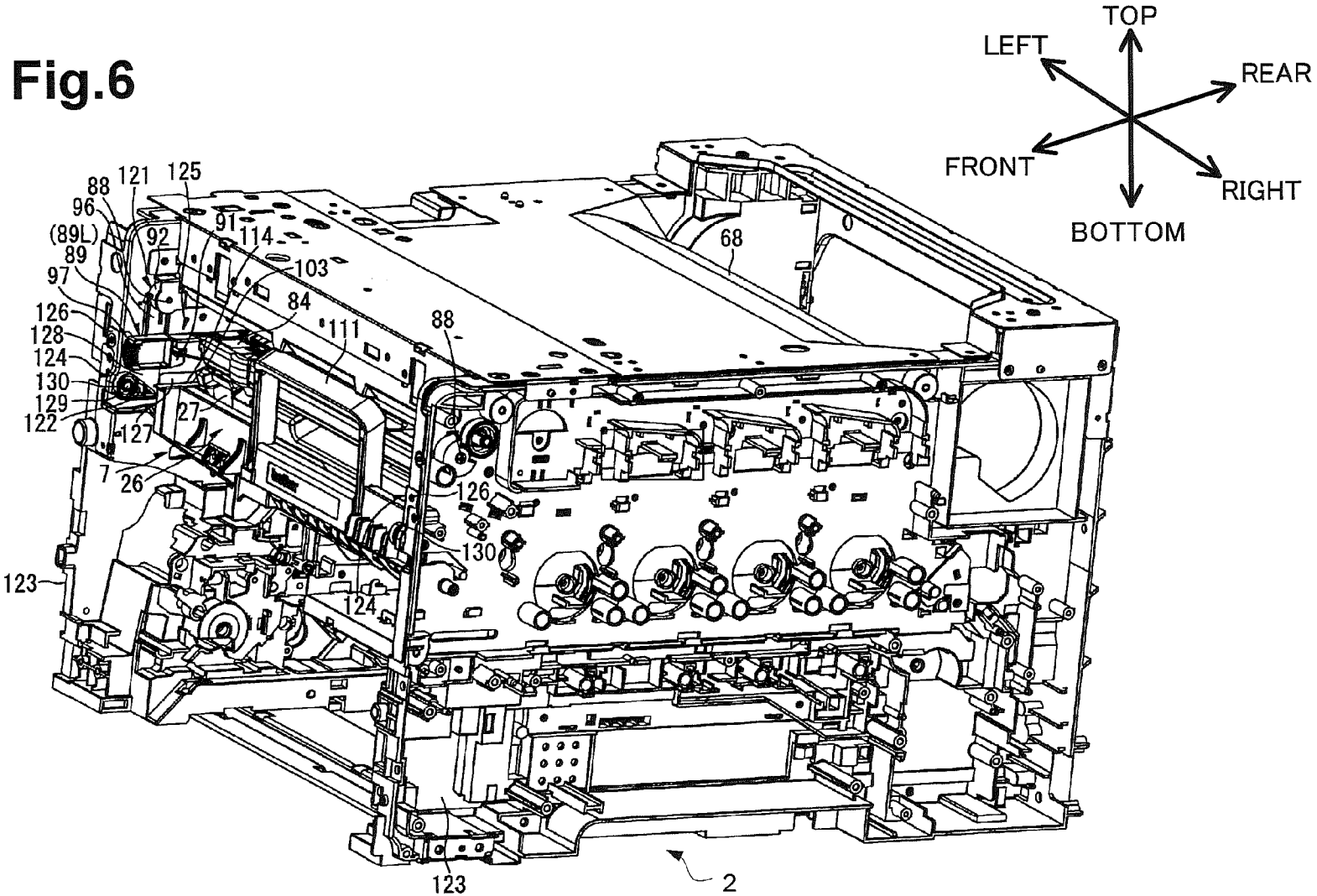
FIG. 6 is a perspective view of a body casing and the drum unit viewed from an upper front right side, wherein outer plates of the body casing and a front cover are removed and the drum unit is installed in the body casing.

As shown in FIG. 6, the body casing 2 includes a pair of body frames 123 disposed oppositely to each other across the drum unit 26. The body frames 123 function as guide walls. Each body frame 123 includes a rail 124, a control portion 121, and a separation pressing mechanism 125 on its inside surface. The rail 124 is configured to guide the drum unit 26 during installation and removal. The control portion 121 is configured to control the movement of the drum unit 26 into or out of the body casing 2. The separation/pressing mechanism 125 is configured to separate or press the developing roller 39 of the developing cartridge 27 installed in the drum unit 26 from or against the corresponding photosensitive drum 29.

As shown in FIG. 6, the rails 124 of the respective body frames 123 are disposed oppositely to each other across the drum unit 26 in the width direction. Each rail 124 includes a rail fixing portion 126 disposed at a front end of the body frame 123, a rail main body 127 extending along the inside surface of the body frame 123, a rail connection portion 128 configured to connect the rail fixing portion 126 and the rail main body 127, and a roller storage portion 132 (FIG. 7) disposed in contact with a rear end of the rail main body 127.

The rail fixing portions 126 are fixed to the front end surfaces of the respective body frames 123.

Figure 7:
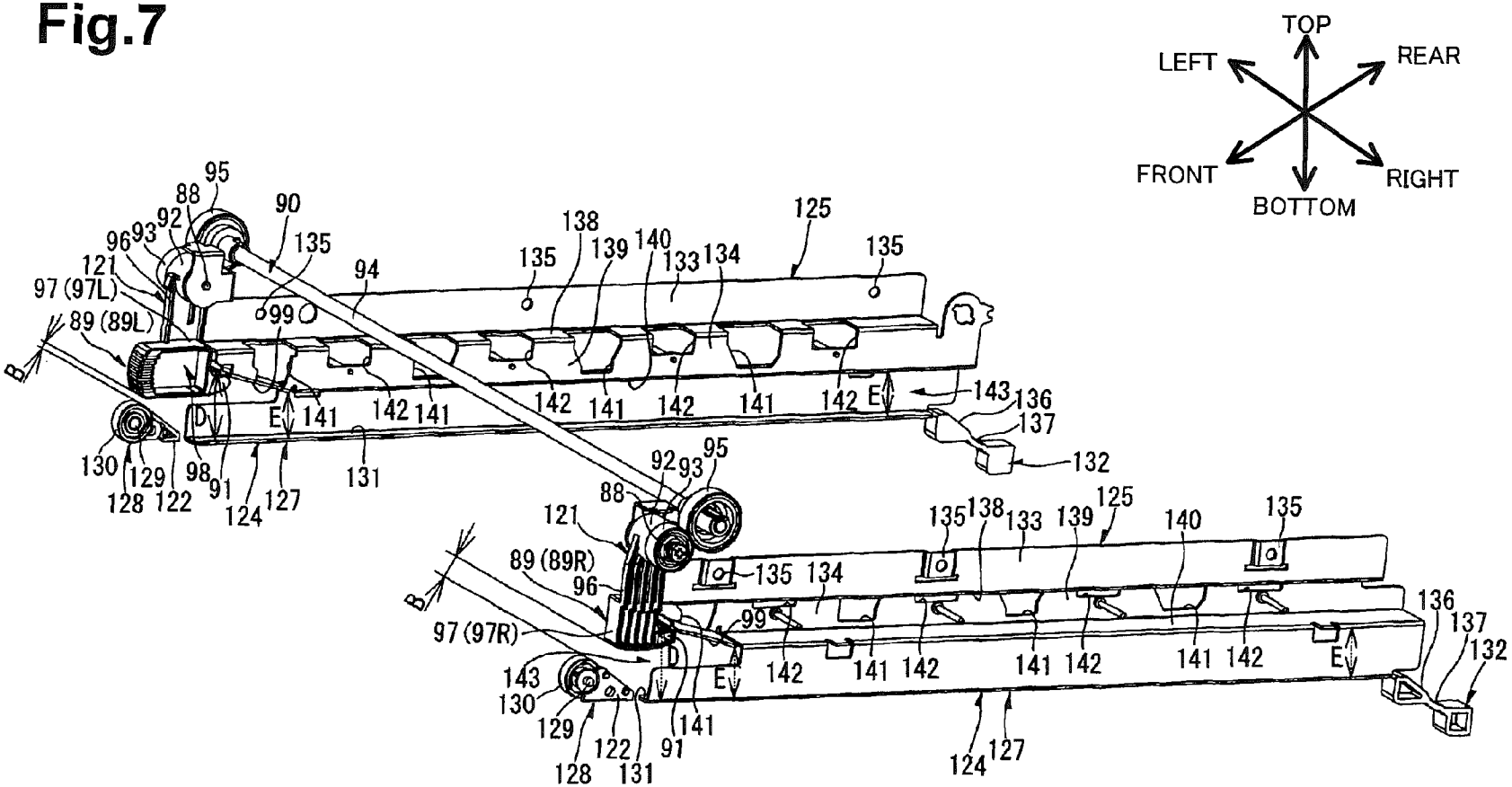
FIG. 7 is a perspective view wherein rails (except for rail fixing portions and some of rail connection portions), control portions, and separation/pressing mechanisms are indicated, and control members are placed in a holding position.

Each rail main body 127 is substantially L shaped in a front view where its bottom end is bent inward in the width direction as shown in FIG. 7. The bottom end, which is defined as a flat portion 131, extends in the width direction. The flanged portion 114 (FIG. 3) of each side plate 103 of the drum unit 26 installed in the body casing 2 is disposed on the flat portion 131 from above. The flat portion 131 can have a dimension in the width direction slightly longer than a dimension in the width direction of the flanged portion 114 and the roller member 118 (FIG. 3).

Each rail connection portion 128 is formed to connect an inside end of the rail fixing portion 126 and a front end of the rail main body 127, as shown in FIG. 6. As shown in FIG. 7, roller shafts 129 are inserted and supported in the corresponding rail connection portions 128 in the width direction. Rail rollers 130 are rotatably supported around the corresponding roller shaft 129 and disposed on inside surfaces of the rail connection portions 128 in the width direction so as to face each other. The rail rollers 130 are configured to have a dimension (thickness) in the width direction substantially equal to the dimension (width) in the width direction of the flat portion 131 of each rail main body 127, and are spaced with a distance substantially equal to that between the right and left rail rollers 118 (FIG. 3) of the drum unit 26. As shown in FIG. 7, each rail roller 130 is disposed such that a top end of its circumferential surface is higher than the flat portion 131 of the rail main body 127.

A protrusion 122 is substantially triangular in a side view and is provided between the rail roller 130 and the rail main body 127. The protrusion 122 is formed such that two sides of the triangle are tangent to each rail roller 130 and the two sides converge slightly before the front end of the flat portion 131. With this configuration, the top end of the circumferential surface of the rail roller 130, an upper surface of the protrusion 122, and an upper surface of the flat portion 131 continue.

Figure 8:
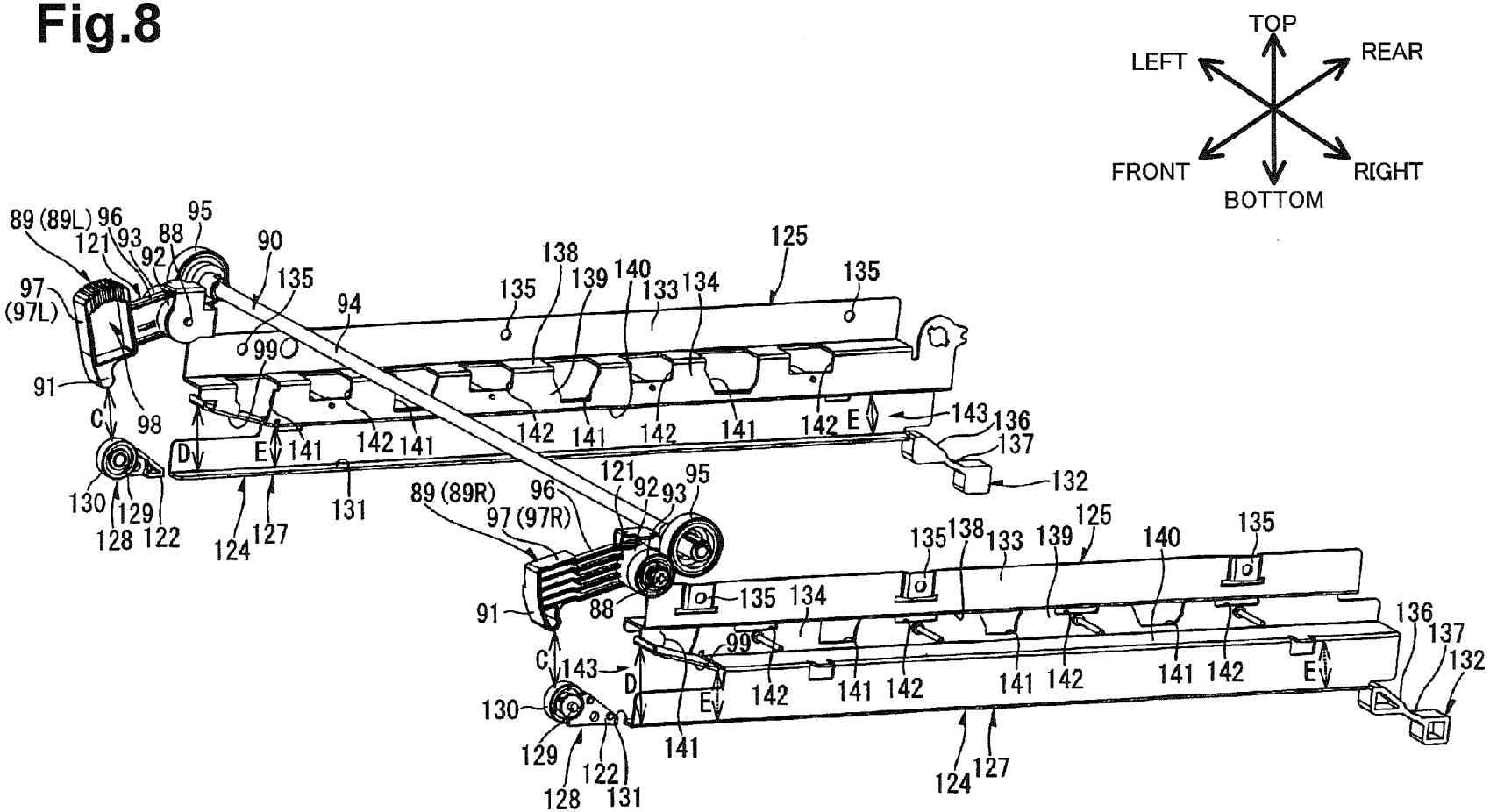
FIG. 8 is a perspective view wherein the rails, the control portions, and the separation/pressing mechanisms are indicated, and the control members are placed in a release position.

The roller storage portion 132 is formed in a substantially FIG. 8 shape where a substantially triangular portion and a substantially square portion are connected at their respective one vertex in a side view. The substantially triangular portion is connected to a rear end of the flat portion 131, and the substantially square portion is disposed diagonally rearward behind the substantially triangular portion. The roller storage portion 132 is formed at its upper surface with an inclined surface 136 continuing from the rear end of the flat portion 131 and extending diagonally rearward and downward. The inclined surface 136 includes a recessed portion 137 at a connection portion of the substantially triangular portion and the substantially square portion of the roller storage portion 132. The recessed portion 137 is recessed diagonally frontward and downward. The inclined surface 136 extends horizontally in the front-rear direction rearward from the recessed portion 137. The roller storage portion 132 has a dimension (thickness) in the width direction substantially equal to the dimension (width) in the width direction of the flat portion 131.

As shown in FIG. 6, the control portion 121 is disposed above the rail connection portion 128 in each body frame 123. Each control portion 121 includes a rotation support shaft 88 and a control member 89. Each control portion 121 is connected with a rotation connection portion 90 (FIG. 7).

The rotation support shaft 88 protrudes inward in the width direction from the inside surface of each body frame 123.

As shown in FIG. 7, the control members 89 of the respective control portions 121 are disposed opposite to each other in the width direction. The control members 89 are spaced with a distance substantially equal to that between the rail rollers 130 in the width direction. In a side view, the left control member 89L is formed in the shape of an inverse T, and the right control member 89R is substantially L-shaped. Each control member 89 integrally includes an insertion portion 92, a joining portion 96, and an interference portion 97, in this order from above.

The insertion portion 92 is formed in a hollow cylindrical shape elongated in the width direction. The rotation support shaft 88 is rotatably supported in the insertion portion 92, so that the control member 89 is rotatably supported in the body frame 123 (FIG. 6).

The insertion portion 92 is formed with a gear portion 93 on a peripheral surface of the outer half side of the insertion portion 92 in the width direction.

The joining portion 96 is formed in a thin plate-like shape extending in a direction outwardly, in a radial direction of the insertion portion 92, from a substantially central portion of the insertion portion 92 in the width direction.

The interference portion 97 is connected to an end of the joining portion 96 opposite from another end thereof connected to the insertion portion 92. The interference portion 97 is substantially rectangularly shaped, in a side view, and protrudes inward more than the joining portion 96 in the width direction. The interference portion 97 has a dimension in the width direction slightly longer than the dimension in the width direction of the corresponding rail roller 130. The interference portion 97 may be slightly thicker than the rail roller 130.

An interference portion 97L of the left control member 89L is connected to the joining portion 96 so that a front end of the interference portion 97L is positioned frontward more than the joining portion 96, and a rear end of the interference portion 97L is positioned rearward more than the joining portion 96. The interference portion 97L is formed with a recessed portion 98 that recesses leftward from the right side surface.

An interference portion 97R of the right control member 89R is connected to the corresponding joining portion 96 so that a front surface of the interference portion 97R is flush with the front surface of the joining portion 96 and a rear end of the interference portion 97R is positioned rearward more than the joining portion 96.

The rear end of each interference portion 97 is formed in a hook shape in a side view, and thus is referred to as a hook 91.

The rotation connection portion 90 is disposed diagonally behind and above the control members 89 and includes a connection shaft 94 and connection gears 95.

The connection shaft 94 is rotatably supported between the body frames 123 (FIG. 6), and the connection gears 95 are fitted around both ends of the connection shaft 94 so as to rotate together with the connection shaft 94.

Each connection gear 95 is engaged with a corresponding one of gear portions 93 of the control members 89. When the user puts his/her finger into the recessed portion 98 of the left control member 89L and actuates the left control member 89L, the force applied to the left control member 89L is transmitted to the gear portion 93 of the left control member 89L, the rotation connection member 90, the right control member 89R, and the gear portion 93 of the right control member 89R, in this order. Thus, the left control member 89L and the right control member 89R rotate together.

Each control member 89 is capable of rotating between a holding position (FIG. 7) and a release position (FIG. 8). In the holding position, each interference portion 97 is positioned at a substantially 6 o'clock position in a right side view, and each hook 91 engages with the front end of the corresponding separation/pressing mechanism 125. In the release position, each interference portion 97 is positioned at a substantially 8 o'clock position in a right side view. Each interference portion 97 faces the corresponding rail roller 130 vertically both in the holding position and the release position.

Each separation/pressing mechanism 125 is disposed adjacent to the rail main body 127 from above and the control member 89 placed in the holding position from the rear. Each separation/pressing mechanism 125 integrally includes a fixing portion 133 and a receiving portion 134. Each separation/pressing mechanism 125 is elongated in the front-rear direction and formed in a substantially inverse P shape in a front cross sectional view.

The fixing portion 133 is formed in a thin plate-like shape, and includes screw holes 135 disposed in the front-rear direction. Screws (not shown) are inserted and tightened in the screw holes 135 of the fixing portion 133, so that the separation/pressing mechanism 125 is fixed to the body frame 123.

The receiving portion 134 is substantially U shaped and recesses inward in the width direction in a front cross sectional view. The receiving portion 134 integrally includes a top surface portion 138, a side surface portion 139, and a bottom surface portion 140, which form its front cross sectional shape.

The top surface portion 138 is disposed so that it is continuous with an upper surface of the interference portion 97 of the control member 89 placed in the holding position. An outer edge of the top surface portion 138 in the width direction is connected to a bottom edge of the fixing portion 133. The top surface portion 138 extends inward in the width direction.

The bottom surface portion 140 is connected to a bottom end of the side surface portion 139 and extends outward in the width direction. An outer edge of the bottom surface portion 140 in the width direction is connected to an upper edge of the rail main body 127. The bottom surface portion 140 vertically faces the flat portion 131 of the rail main body 127. A front edge of the bottom surface portion 140 has an inclined portion 99 that inclines from the lower bottom to the upper front.

The separation/pressing mechanism 125 has four first cutout portions 141 provided at equal intervals along the front-rear direction. Each first cutout portion 141 is provided extending from the outer edge of the top surface portion 138 to a lower portion of the side surface portion 139. The first cutout portions 141 are sized to be capable of receiving the pressing protrusions 82 (FIG. 5) of the corresponding developing cartridges 27.

Four second cutout portions 142 are formed at the rear of the corresponding first cutout portions 141. Each second cutout portion 142 is provided extending from the outer edge of the top surface portion 138 to a substantially vertically central portion of the side surface portion 139. The second cutout portions 142 are formed to a size capable of receiving the separation protrusions 83 (FIG. 5) of the corresponding developing cartridges 27.

In each body frame 123 of the body casing 2, there is a space vertically defined by the bottom surface portion 140 of the separation/pressing mechanism 125, the control member 89 of the control portion 121, the flat portion 131 of the rail 124, the inclined surface 136 of the roller storage portion 132, and the rail roller 130 and the protrusion 122 in the rail connection portion 128. This space provides a guide region 143 for guiding the drum unit 26 when it is attached to and removed from the body casing 2. When the drum unit 26 is attached to or removed from the body casing 2, the roller members 118 (FIG. 3) and the flanged portions 114 can be slid in the guide regions 143.

A dimension (height) of the guide region 143 at its front end is the shortest distance between the control member 89 and the rail roller 130. A shortest distance B between the control member 89 placed in the holding position and the rail roller 130 is set smaller than an outer diameter A of the roller member 118 (FIG. 3) of the drum unit 26. As shown in FIG. 8, a shortest distance C between the control member 89 placed in the release position and the rail roller 130 is set greater than the outer diameter A of the roller member 118.

In each guide region 143, a shortest distance D between a front end of the inclined portion 99 of the bottom surface portion 140 of the separation/pressing mechanism 125 and the flat portion 131 of the rail 124 is set greater than the outer diameter A of the roller member 118. A shortest distance E between a rear end of the inclined portion 99 and the flat portion 131 is smaller than the shortest distance D but is set greater than the outer diameter A of the roller member 118. A distance between the flat portion 131 and the bottom surface portion 140 except for the inclined portion 99 is set constantly with the distance E.

Installation of the drum unit 26 in the body casing 2 will be described in detail with reference to FIGS. 1, 3 and 9 through 17.

To attach the drum unit 26 to the body casing 2, the front handle portion 111 (FIG. 3) and the rear handle portion 113 (FIG. 3) of the drum unit 26 are held and raised with both hands. The front cover 9 (FIG. 1) is tilted down to uncover the opening 8, the control members 89 are rotated to the release position (FIG. 9), and the drum unit 26 is inserted into drum accommodating space 7 from front to rear. When the drum unit 26 is installed in the drum accommodating space 7 of the body casing 2, the drum unit 26 is placed in a first position.

Figure 9:
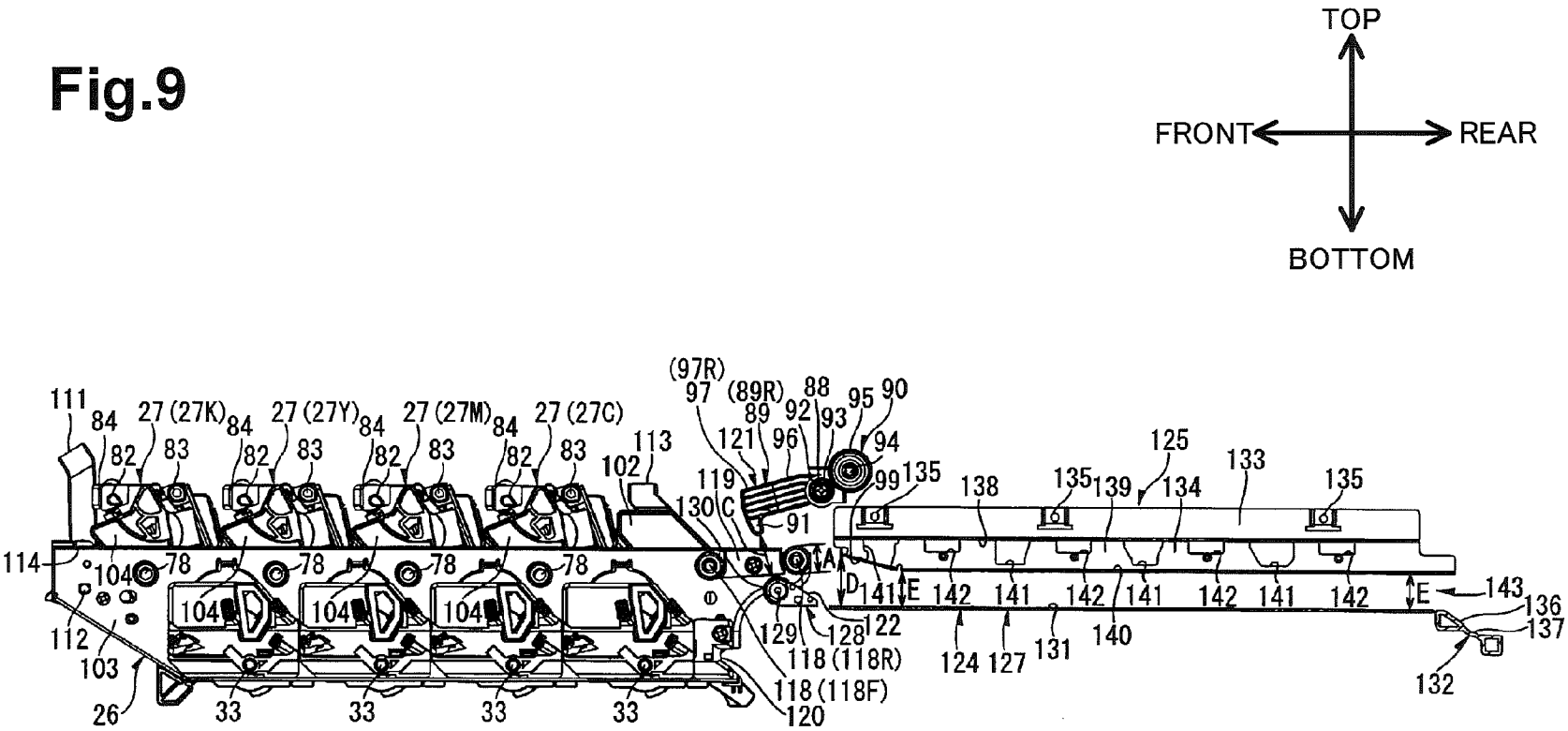
FIG. 9 is a right side view showing the drum unit, the rail, the control portion, and the separation/pressing mechanism, wherein the control member is placed in the release position, and a spacer of the drum unit moves on top of the rail roller.

As shown in FIG. 9, the shortest distance C between the control member 89 placed in the release position and the rail roller 130 is greater than the outer diameter A of the roller member 118. Thus, when the drum unit 26 is inserted into the drum accommodating space 7 of the body casing 2, the roller member 118R can pass in between the control member 89 and the rail roller 130, enter the guide region 143, and move over the rail roller 130. In FIG. 9, the roller member 118R moves past the rail roller 130, and the spacer 119 moves on top of the rail roller 130.

Figure 10:
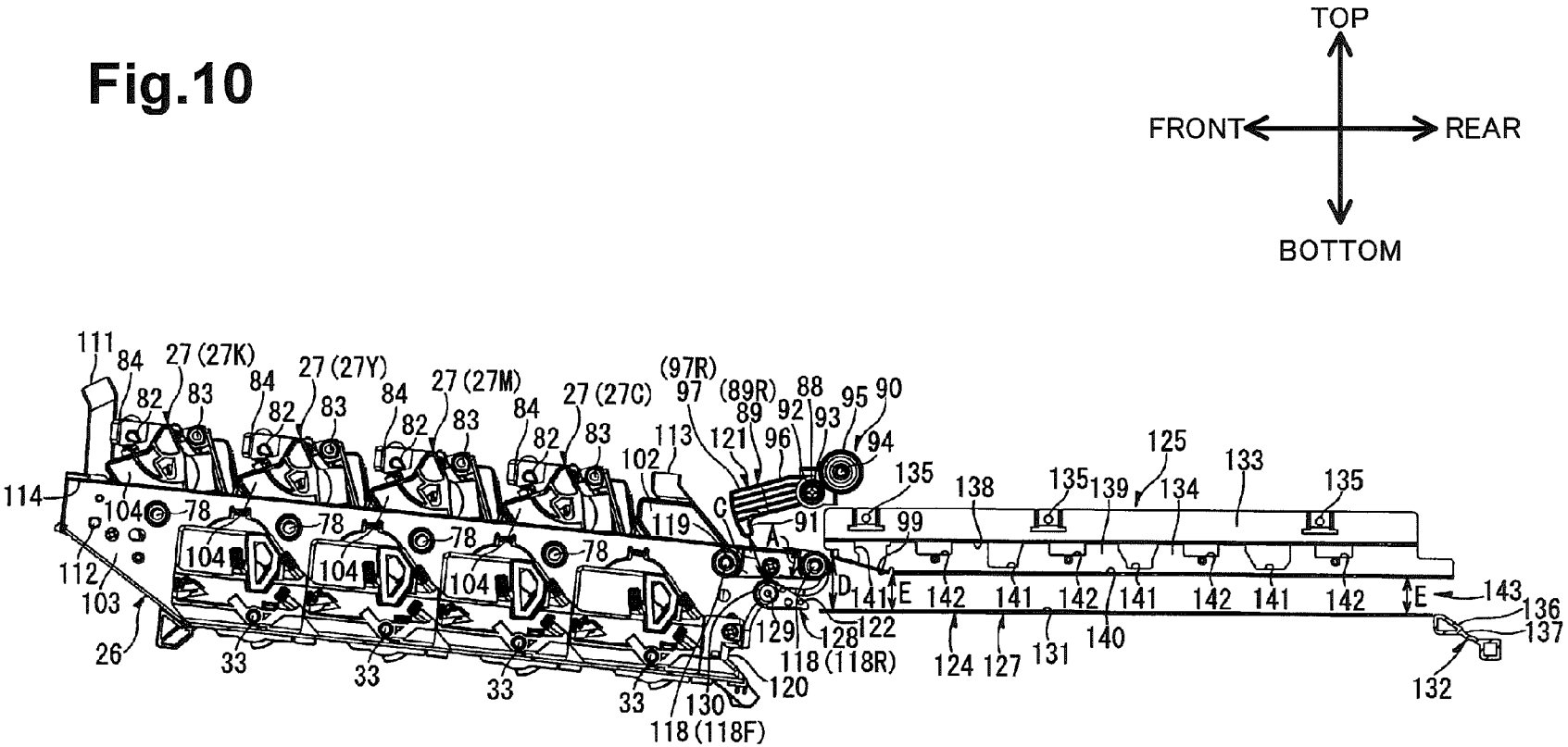
FIG. 10 is a right side view wherein the drum unit shown in FIG. 9 is inserted further rearward toward the body casing.

When the drum unit 26 is inserted further rearward as it is held in a posture shown in FIG. 9, the roller member 118R contacts the front end of the inclined portion 99 of the bottom surface portion 140 of the separation/pressing mechanism 125 as shown in FIG. 10. As described above, the shortest distance D between the front end of the inclined portion 99 and the flat portion 131 of the rail 124 is greater than the outer diameter A of the roller member 118. Thus, the roller member 118R can move rearward in the guide region 143.

Figure 11:
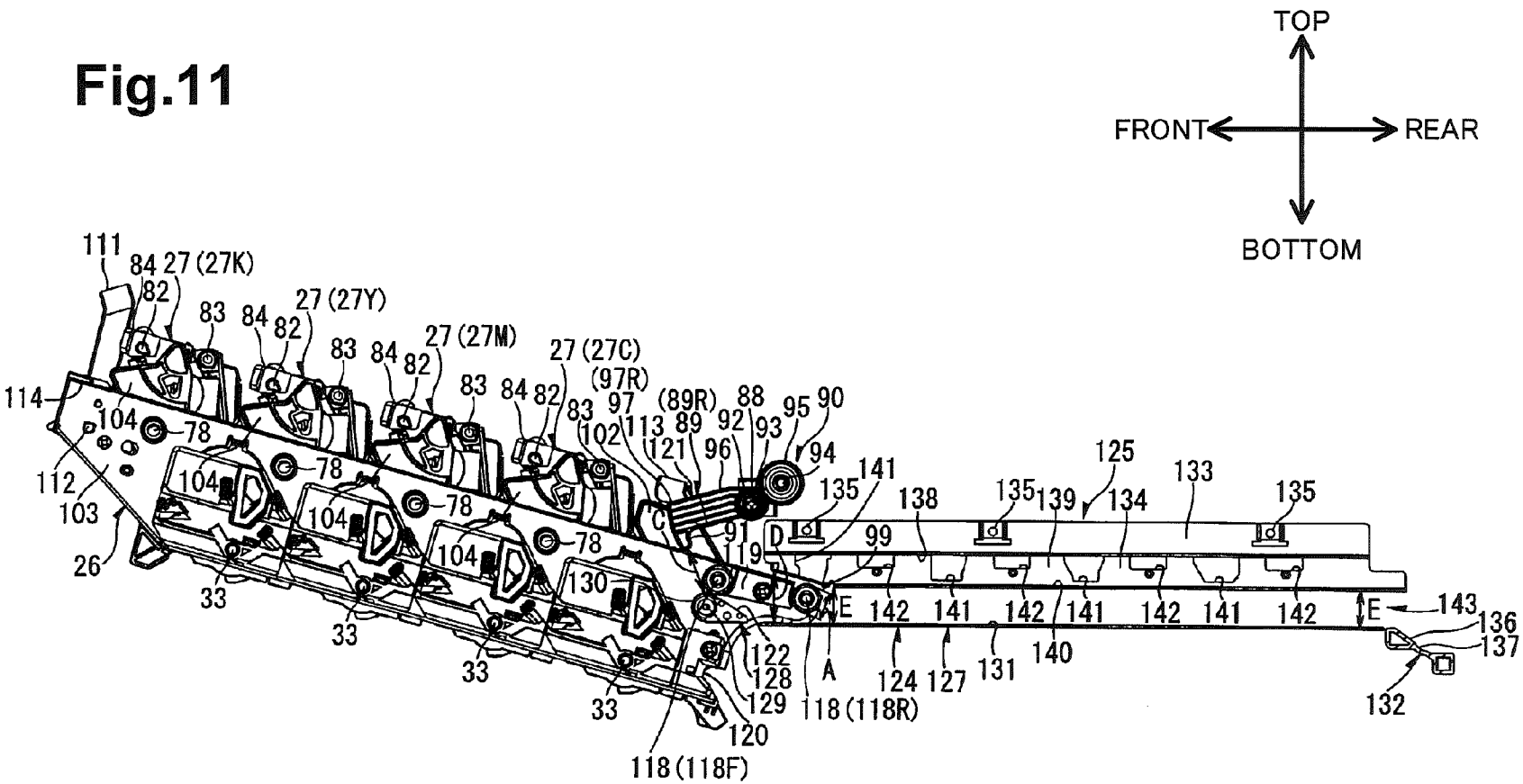
FIG. 11 is a right side view wherein the drum unit shown in FIG. 10 is inserted further rearward toward the body casing and a front roller member moves on top of the rail roller.

When the drum unit 26 is inserted further, the roller member 118R is guided by the inclined portion 99 of the bottom surface portion 140, and approaches the rear end of the inclined portion 99 as shown in FIG. 11. Accordingly, the drum unit 26 is inclined with its front end placed higher than its rear end. At this time, the roller member 118F moves on top of the rail roller 130. As described above, the shortest distance E between the rear end of the inclined portion 99 of the bottom surface portion 140 and the flat portion 131 is greater than the outer diameter A of the roller member 118. Thus, the roller member 118R can move further rearward in the guide region 143.

Figure 12:
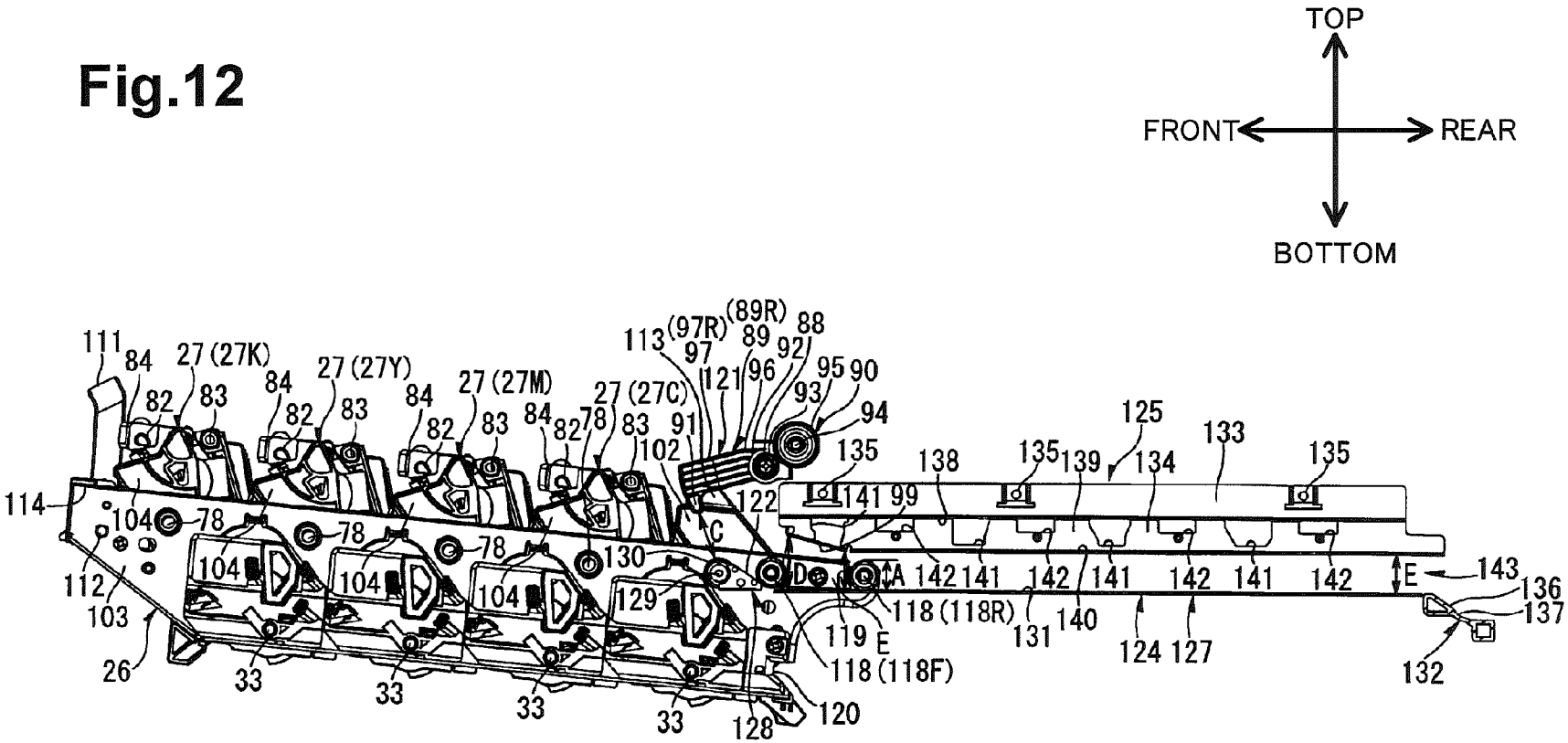
FIG. 12 is a right side view wherein the drum unit shown in FIG. 11 is inserted further rearward toward the body casing and the front roller member moves past the rail roller.

When the drum unit 26 is inserted further rearward, the roller member 118F moves past the rail roller 130 and the protrusion 122, and the roller members 118F and 118R are disposed on top of the flat portion 131, as shown in FIG. 12. At this time, the drum unit 26 is placed in a second position. When the drum unit 26 is placed in the second position, all developing cartridges 27 installed in the drum unit 26 are exposed, and the developing cartridges 27 can be removed from the drum unit 26.

Figure 13:
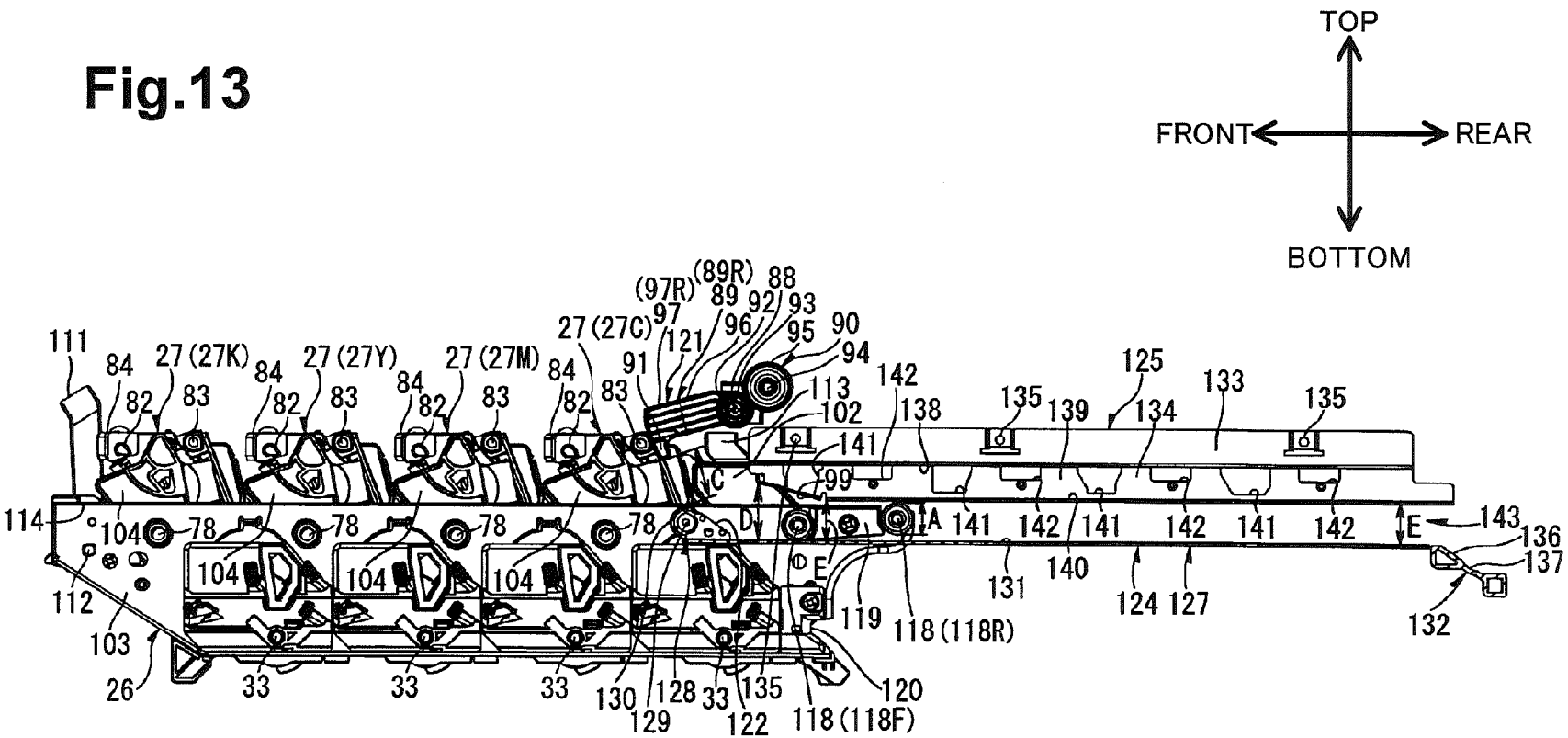
FIG. 13 is a right side view wherein the drum unit shown in FIG. 12 is inserted further rearward toward the body casing and an interference portion of the control member placed in the release position contacts a separation protrusion of the developing cartridge.

In this situation, when the user releases the front handle portion 111 and the rear handle portion 113, the drum unit 26 can be moved from the current position where the front end is positioned higher than the rear end to a position shown in FIG. 13 where the front end is level with the rear end. At this time, the rail roller 130 contacts the bottom surface of the flanged portion 114, the roller member 118F contacts the upper surface of the flat portion 131, and the roller member 118R contacts the bottom surface of the bottom surface portion 140, so that the drum unit 26 is supported by the body casing 2. Unless the roller members 118F and 118R move frontward over the rail roller 130, the drum unit 26 can not be separated from the body casing 2. In a situation shown in FIG. 13, the drum unit 26 does not fall off the body casing 2 even if the user releases the front handle portion 111 and the rear handle portion 113.

When the user holds the front handle portion 111 and inserts the drum unit 26 further rearward, the interference portion 97 of each control member 89 placed in the release position contacts the corresponding separation protrusion 83 of the developing cartridge 27C arranged at the most rear side in the drum unit 26, and the drum unit 26 is prevented from moving further rearward.

Figure 14:
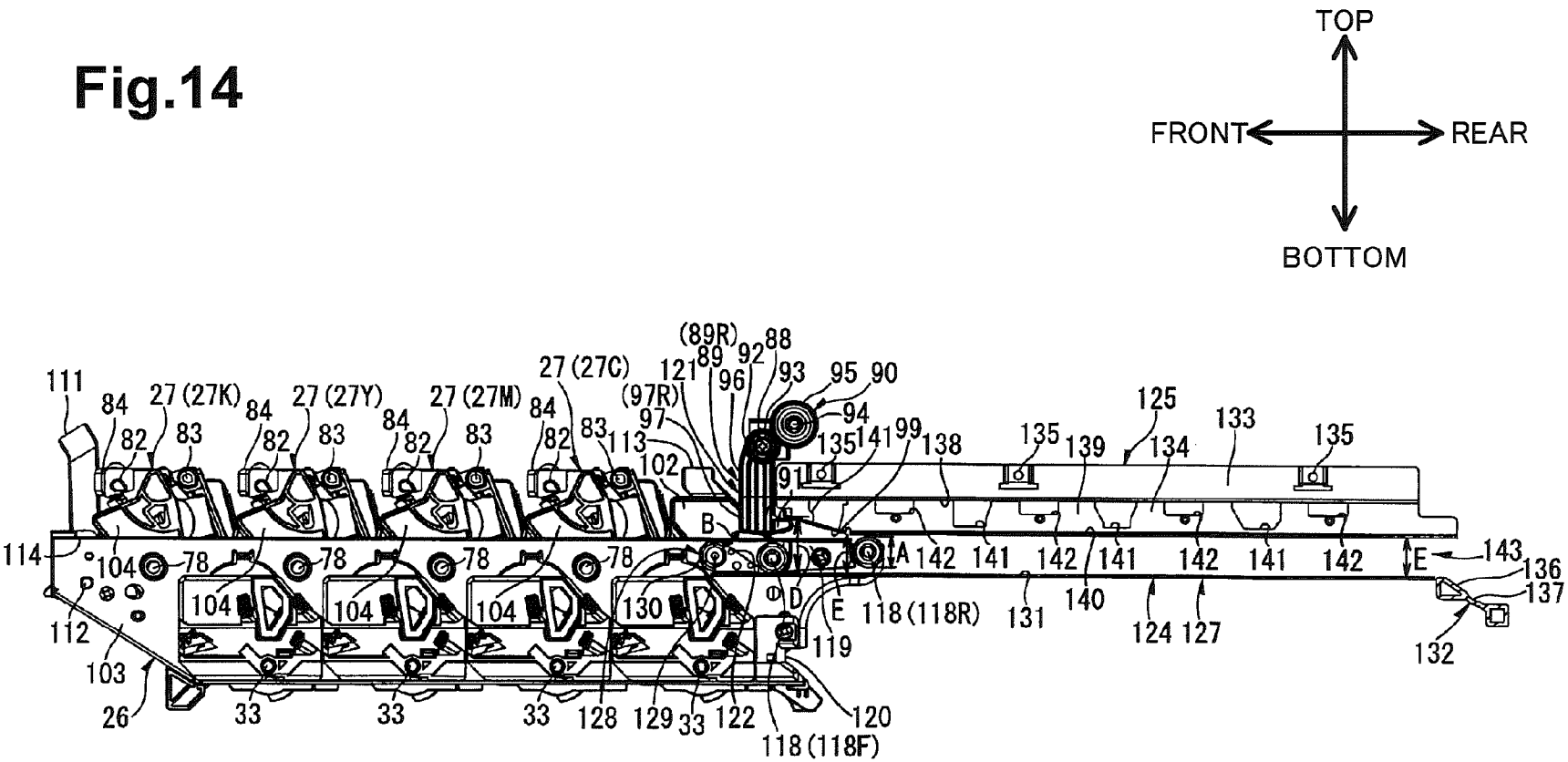
FIG. 14 is a right side view wherein the control member shown in FIG. 13 is placed in the holding position.

Thus, as shown in FIG. 14, when the control member 89 is rotated to the holding position, the corresponding separation protrusion 83 is allowed to pass the inner space between the interference portion 97 and the insertion portion 92 of the control member 89, that is the inner side of the joining portion 96 (FIG. 7) of the control member 89, in the width direction, and thus the drum unit 26 is allowed to move rearward.

When the drum unit 26 is inserted further rearward, each roller member 118 rotates on the flat portion 131 of the rail main body 127 while the flanged portion 114 slides on the rail roller 130. In this way, the drum unit 26 smoothly moves. The separation protrusions 83 and pressing protrusions 82 of each developing cartridge 27 slide on the upper surface portion 138 of each separation/pressing mechanism 125.

Figure 15:
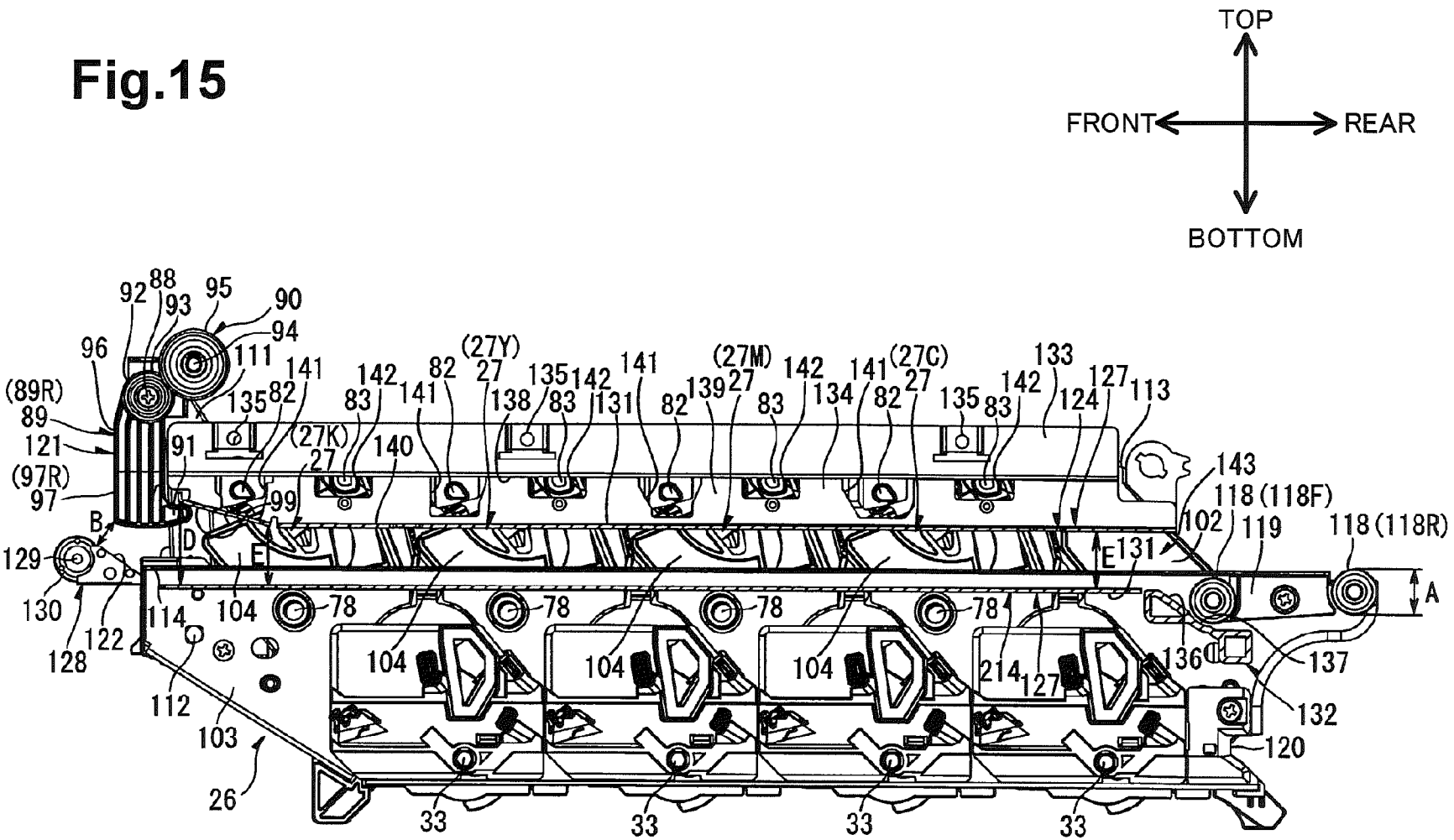
FIG. 15 is a right side view wherein the drum unit shown in FIG. 14 is inserted further rearward toward the body casing and is completely installed in the body casing.
Figure 16:
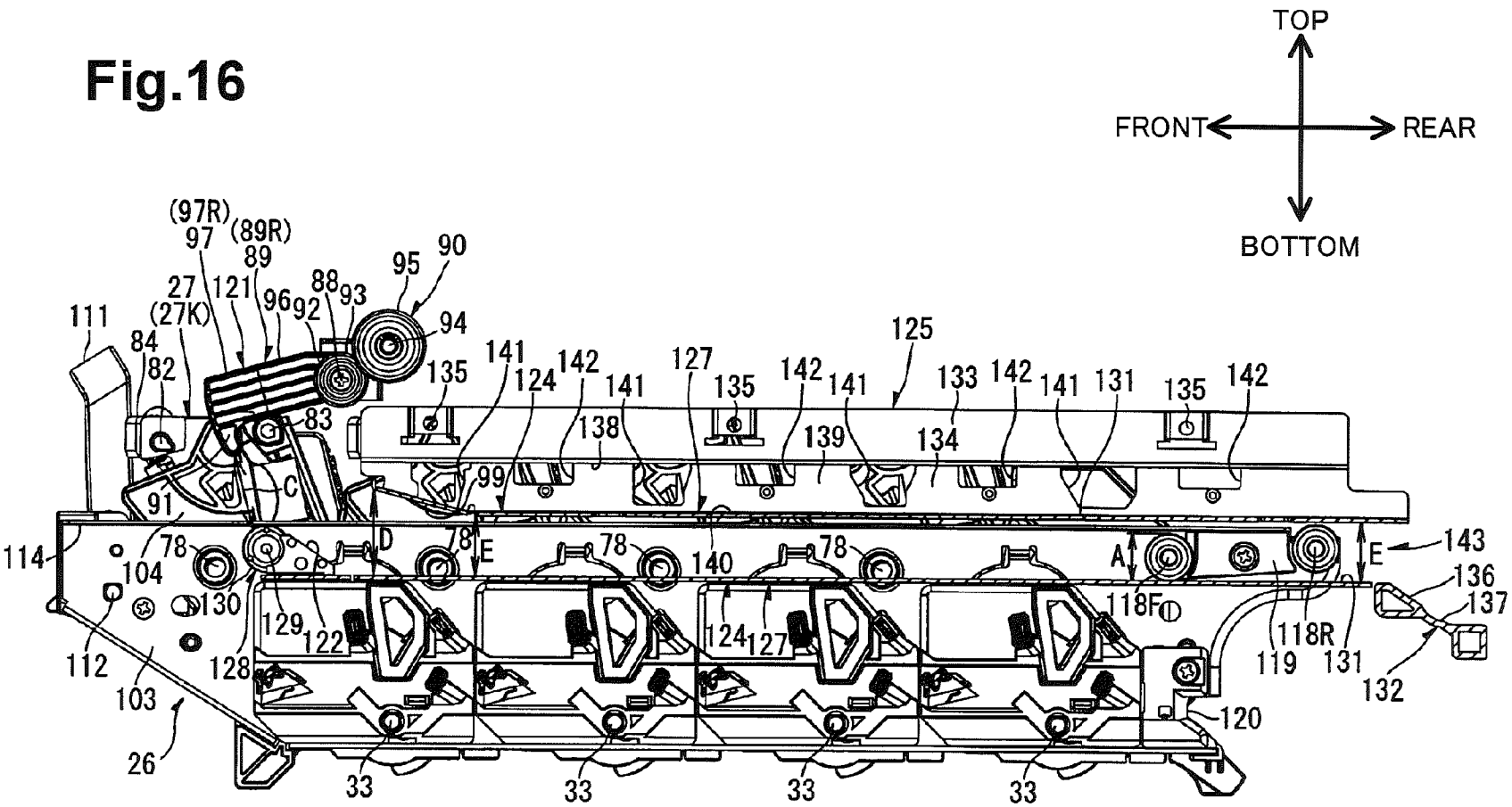
FIG. 16 is a right side view wherein the control member shown in FIG. 15 is rotated to the release position, the drum unit is pulled frontward from the body casing, and a hook of the control member is engaged with a separation protrusion of the developing cartridge.

When the drum unit 26 is inserted further rearward, each roller member 118 drops off the rear end of the flat portion 131, the flanged portion 114 drops off the rail roller 130 and is placed above the flat portion 131 as shown in FIG. 15. At this time, the roller member 118F is engaged in the recessed portion 137 of the roller storage portion 132. In each developing cartridge 27, each pressing protrusion 82 is received in the corresponding first cutout portion 141 of the separation/pressing mechanism 125, and each separation protrusion 83 is received in the corresponding second cutout portion 142. Thus, the drum unit 26 is completely installed in the body casing 2. At this time, the drum unit 26 is placed in the first position.

Then, the user releases the front handle portion 111 and closes the front cover 9 (FIG. 1) to cover the opening 8 (FIG. 1).

In each separation/pressing mechanism 125, a pressing mechanism (not shown) is provided in each first cutout portion 141, and a separation mechanism (not shown) is provided in each second cutout portion 142. In a state where the drum unit 26 is installed in the body casing 2 as shown in FIG. 1, the color laser printer 1 can form a color image using the four drum sub units 28 and a monochrome image using the black drum sub unit 28 only, selectively according to the user's purpose.

Specifically, the user operates an operation panel (not shown), and selects whether an image is formed in color or monochrome. When an image is formed in color, the pressing mechanism (not shown) applies downward force to the pressing protrusions 82 (FIG. 5) of the four developing cartridges 27. The front end of the handle 84 including the pressing protrusions 82 moves to the front end of the top wall 74 of the developing frame 36 against an urging force of an elastic member (not shown) provided in the handle 84. Along with the movement, the urging force of the elastic member (not shown) acts on the front end of the top wall 74 in a direction to separate from the front end of the handle 84 (downwardly). Thus, each developing frame 36 of the four developing cartridges 27 moves downward, each developing roller 39 is pressed against the surface of the corresponding photosensitive drum 29 as shown in FIG. 1, toner on each developing roller 39 is supplied to the corresponding photosensitive drum 29, and a color image is formed.

When a monochrome image is formed, downward force is applied to the pressing protrusions 82 (FIG. 5) of the black developing cartridge 27K only. In the other developing cartridges 27 except for the black developing cartridge 27K, upward force is applied to the separation protrusions 83 by the separation mechanism (not shown). Thus, the black developing cartridge 27K moves downward, and the developing roller 39 of the black developing cartridge 27K is pressed against the surface of the photosensitive drum 29 of the black drum sub unit 28K. On the other hand, the other developing cartridges 27 except for the black developing cartridge 27K move upward, and their developing rollers 39 are separated from the corresponding photosensitive drums 29. Thus, toner on the developing cartridge 39 of the black developing cartridge 27K only is applied to the photosensitive drum 29 of the black drum sub unit 28K, and a monochrome image is formed.

Removal of the drum unit 26 from the body casing 2 will be described below.

When the drum unit 26 is removed from the body casing 2, the front cover 9 (FIG. 1) is tilted to uncover the opening 8, the front handle portion 111 (FIG. 16) is held, and the drum unit 26 is pulled frontward. At this time, the roller member 118F in the drum unit 26 is removed from the recessed portion 137 of the roller storage portion 132, guided along the inclined surface 136 of the roller storage portion 132, and moves on the flat portion 131 of the rail main body 127. Each flanged portion 114 of the drum unit 26 moves on top of the corresponding rail roller 130. The pressing protrusions 82 and the separation protrusions 83 of each developing cartridge 27 are separated from the corresponding first output portions 141 and second output portions 142 diagonally upward and frontward.

When each control member 89 is placed in the release position, the hook 91 engages with the corresponding separation protrusion 83 of the black developing cartridge 27K disposed at the front of the drum unit 26, so that the drum unit 26 is prevented from moving further forward.

Figure 17:
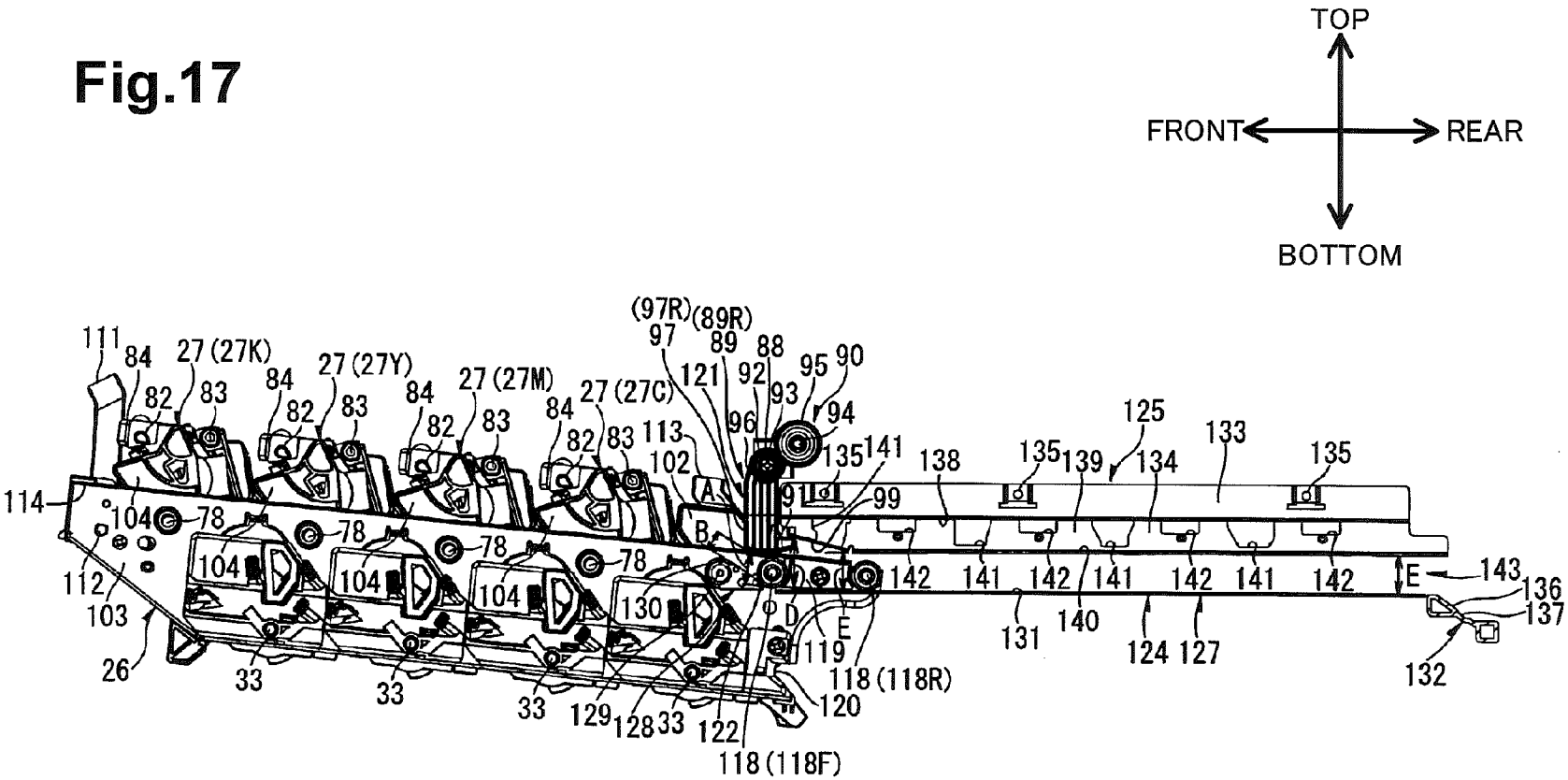
FIG. 17 is a right side view wherein the drum unit shown in FIG. 14 is being pulled frontward from the body casing.

When the control member 89 is rotated to the holding position as shown in FIG. 17, the corresponding separation protrusion 83 is allowed to pass the inner space between the interference portion 97 and the insertion portion 92 of the control member 89, that is the inner side of the joining portion 96 of the control member 89, in the width direction, and thus the drum unit 26 is allowed to move frontward.

When the roller member 118F of the drum unit 26 contacts the protrusion 122 of the rail connection portion 128, the drum unit 26 is placed in the second position, and the drum unit 26 is stopped from moving frontward. The interference portion 97 of the control member 89 contacts the upper surface of the flanged portion 114 of the drum unit 26. The shortest distance B between the control member 89 and the rail roller 130 is smaller than the outer diameter A of the roller member 118F (which includes the thickness of the flanged portion 114 adjacent to the roller member 118F), as described above. Thus, the roller member 118F can not move over the protrusion 122 and the rail roller 130, and the drum unit 26 can not be separated from the body casing 2.

However, as the control member 89 is rotated to the release position, the roller members 118F and 118R can move over the protrusion 122 and the rail roller 130 as shown in FIGS. 9 and 11. In the drum unit 26 placed in the second position, the rear handle portion 113 is exposed outside and can be operated. Thus, the user can grasp the front handle portion 111 and the rear handle portion 113 again with both hands to pull the drum unit 26 out frontward. As shown in FIG. 9, the roller member 118R passes frontward between the control member 89 placed in the release position and the rail roller 130, and the roller member 118 and the flanged portion 114 disengaged from the guide region 143, so that the drum unit 26 is completely removed from the body casing 2. At this time, the drum unit 26 is placed in a third position.

In the laser printer 1, the dimension (height) of the guide region 143 at the most downstream side in the direction where the drum unit 26 is pulled out from the body casing 2, in other words, the dimension of the guide region 143 at its front end, is the shortest distance between the control member 89 and the rail roller 130. When the control member 89 is placed in the holding position, the shortest distance is maintained with B (second guide region dimension) which is smaller than the outside diameter A of the roller member 118 of the drum unit 26. When the control member 89 is placed in the release position, the shortest distance between the control member 89 and the rail roller 130 is extended to C (third guide region dimension) which is greater than the outside diameter A of the roller member 118. In the guide region 143, the dimension of the guide region in a portion rearward from the front end, that is, the dimension of the guide region between the bottom surface portion 140 of each separation/pressing mechanism 125 and the flat portion 131 of the rail 124, is defined as D or E (first guide region dimension) which is greater than the outside diameter A of the roller member 118.

Thus, when the drum unit 26 is installed in or removed from the body casing 2, the roller member 118 is guided in a portion where the first guide region dimension is formed in the guide region 143, the drum unit 26 can smoothly move between the first position and the second position.

However, unless the control member 89 is placed in the release position even if the drum unit 26 is withdrawn to the second position, the roller member 118 can not pass in between the control member 89 and the rail roller 130, and the drum unit 26 can not move to the third position. Thus, when the control member 89 is placed in the holding position, the drum unit 26 can be surely controlled in its movement between the first position and the second position. When the drum unit 26 is placed in the second position, the user can hold the drum unit 26 before the control member 89 is moved to the release position, and the drum unit 26 can be removed from the body casing 2 with a stable posture simply and surely. To hold the drum unit 26 removed from the body casing 2 again, there is no need to provide the apparatus with a member for temporarily placing the drum unit 26, and thus the apparatus can be smaller in size.

When the control member 89 is placed in the release position, the roller member 118 of the drum unit 26 can pass in between the control member 89 and the rail roller 130, and the drum unit 26 can be moved between the second position and the third position surely.

When the control member 89 is placed in the release position and the drum unit 26 in the second position is pressed rearward toward the first position, the interference portion 97 of each control member 89 in the release position contacts the corresponding separation protrusion 83 of the developing cartridge 27C disposed at the rear end of the drum unit 26, and the drum unit 26 is controlled from moving further rearward. When the drum unit 26 placed in the first position is pulled frontward toward the second position, the hook 91 of each control member 89 in the release position engages with the corresponding separation protrusion 83 of the developing cartridge 27K disposed at the front end of the drum unit 26, and the drum unit 26 is controlled from moving further forward.

Thus, with the control member 89 being placed in the release position, the drum unit 26 is controlled in its movement between the first position and the second position. When the drum unit 26 is placed in the first position, it can be controlled from unnecessarily moving toward the second position. That is, the drum unit 26 can be prevented from moving from the first position directly to the third position without stop. When the drum unit 26 is placed in the second position, it can be controlled from unnecessarily moving toward the first position. That is, in a state where the control member 89 is not returned to the holding position, the drum unit 26 cannot be moved to the first position, and thus can be prevented from moving into the drum accommodating space 7.

The drum unit 26 includes the front handle portion 111 and the rear handle portion 113. With the front handle portion 111, the drum unit 26 in the first position can be easily pulled toward the second position. When the drum unit 26 is placed in the second position, the rear handle portion 113 can be operated. When the drum unit 26 is placed in the second position, all developing cartridges 27 can be installed in or removed from the drum unit 26. Thus, the user can hold the front handle portion 111 and the rear handle portion 113, which are suitable portions of the drum unit 26 to be held except for the developing cartridges 27, and remove the drum unit 26 from the body casing with a stable posture and easily and securely.

The control members 89 are rotatably provided at both ends of the body casing 2 in the width direction, which is perpendicular to a direction where the drum unit 26 is withdrawn from the body casing 2. Thus, the control members 89 are easily moved between the holding position and the release position, so that the movement of the drum unit 26 is controlled. The movement of the control members 89 is implemented only by provision of the rotation support shafts 88, thus facilitating a configuration to move the control members 89 between the holding position and the release position.

The control members 89L and 89R disposed at both sides of the body casing 2 in the width direction are rotated together by the rotation connection portion 90. Thus, when the control members 89 are rotated from the holding position to the release position, there is no need to rotate the control members 89L and 89R independently, thus improving operability.

In the drum unit 26 according to the above aspect, each developing cartridge 27 is provided separately from the corresponding drum sub unit 28 so as to be individually installed in or removed from the corresponding drum sub unit 28. However, the developing cartridge 27 and the drum sub unit 28 may be integrally formed for each color. In this case, when the drum unit 26 is replaced with a new one, the toner, the developing roller 39, and the photosensitive drum 29 for each color may be replaced at a time.

In the above embodiment, the color laser printer 1 illustrated is a tandem-type in which an image is transferred from each photosensitive drum 29 directly to a sheet 3, and is not intended to be limiting. For example, the color laser printer 1 may be constructed as an intermediate transfer type in which a toner image of each color is transferred from each photosensitive member to an intermediate transfer medium, and then transferred to a sheet at a time. Alternatively, the color laser printer 1 may be constructed as a monochrome laser printer. The monochrome laser printer may be provided with a process unit functioning as an image formation unit where one developing cartridge 27 is installed in one drum sub unit 28.

What is claimed is:

1. An image forming apparatus comprising:

a body casing having opposed sides;

a photosensitive member unit configured to be inserted into and withdrawn from the body casing, the photosensitive member unit being configured to move between a first position in which the photosensitive member unit is stored in the body casing, and a second position in which the photosensitive member unit is withdrawn from the body casing, the photosensitive member unit being configured to move between the second position and a third position in which the photosensitive member unit is completely removed from the body casing, the photosensitive member unit being configured to hold a plurality of photosensitive members; and a control mechanism disposed in the body casing, the control mechanism including:

a connecting member extending between the opposed sides of the body casing in a direction perpendicular to the withdrawal direction, the connecting member including a first end portion and a second end portion;

a first control member connected to the first end portion of the connecting member; and a second control member connected to the second end portion of the connecting member, wherein the control mechanism is configured such that the connecting member transmits a drive force between the first control member and the second control member, and each of the first and second control members is configured to move between a holding position in which the photosensitive member unit is allowed to move between the first position and the second position and a release position in which the photosensitive member unit is allowed to move between the second position and the third position.

2. The image forming apparatus according to claim 1, wherein the connecting member includes a shaft rotatably supported by the opposed sides of the body casing, a first rotator disposed at a first end portion of the shaft, and a second rotator disposed at a second end portion of the shaft.

3. The image forming apparatus according to claim 1, wherein the connecting member includes a shaft rotatably supported by the opposed sides of the body casing, a first gear disposed at a first end portion of the shaft, and a second gear disposed at a second end portion of the shaft, the first control member includes a third gear that engages with the first gear, and the second control member includes a fourth gear that engages with the second gear.

4. The image forming apparatus according to claim 1, wherein the control mechanism includes a first transmission member and a second transmission member, the first transmission member is configured to transmit a drive force of the first control member to the connecting member, and the second transmission member is configured to transmit the drive force, transmitted from the first control member, from the connecting member to the second control member.

5. The image forming apparatus according to claim 4, wherein the connecting member includes a shaft that is rotatably supported by the opposed sides of the body casing.

6. The image forming apparatus according to claim 5, wherein the first transmission member includes a first gear disposed at the first end portion of the shaft, the second transmission member includes a second gear disposed at the second end portion of the shaft, the first control member includes a third gear that engages with the first gear, and the second control member includes a fourth gear that engages with the second gear.

7. The image forming apparatus according to claim 1, wherein each of the first control member and the second control member includes an interference portion, and when the first control member and the second control member are in the release position, the photosensitive member unit contacts the interference portion and is prevented from moving between the first position and the second position.

8. The image forming apparatus according to claim 1, wherein the connecting member includes a shaft that is rotatably supported by the opposed sides of the body casing, and the first and second control members rotate around the shaft between the holding position and the release position.

9. The image forming apparatus according to claim 1, wherein the control mechanism includes a first rotating member and a second rotating member, the first rotating member is connected to the first end portion and the first control member, and the second rotating member is connected to the second end portion and the second control member.

10. The image forming apparatus according to claim 1, further comprising a plurality of developer supply units detachably attached to the photosensitive member unit in association with the plurality of photosensitive members, each of the developer supply units being configured to contain and supply a developer, and wherein the plurality of developer supply units are configured to be removed from and attached to the photosensitive member unit when the photosensitive member unit is placed in the second position.

11. The image forming apparatus according to claim 1, wherein each of the opposed sides of the body casing is formed with a guide region having a first height, the photosensitive member unit is guided in and out of the body casing through each guide region, wherein a member is disposed at a most downstream portion of each guide region in the withdrawal direction, and a second height of the guide region at the most downstream portion of the guide region is less than the first height of the guide region at an upstream portion of the guide region, wherein the first and second control members are disposed at the most downstream portion of each guide region, the first and second control members maintaining the second height at the most downstream portion in the holding position, the first and second control members maintaining a third height at the most downstream portion in the release position greater than the second height, wherein the photosensitive member unit includes a guided portion at a most upstream side of the photosensitive member unit in the withdrawal direction, the guided portion being disposed in the guide region and guided along the guide region when the photosensitive member unit is inserted into and withdrawn from the body casing, and a maximum dimension of the guided portion in a direction in which the guided portion is disposed in the guide region is less than the first height and the third height, and is greater than the second height.

12. An image forming apparatus comprising:

a body casing having a first guide wall and a second guide wall disposed opposite to the first guide wall;

a photosensitive member unit configured to be inserted into and withdrawn from the body casing, the photosensitive member unit being configured to move between a first position in which the photosensitive member unit is stored in the body casing, and a second position in which the photosensitive member unit is withdrawn from the body casing, the photosensitive member unit being configured to move between the second position and a third position in which the photosensitive member unit is completely removed from the body casing, the photosensitive member unit being configured to hold a plurality of photosensitive members; and a control mechanism disposed in the body casing, the control mechanism including:

a first control member disposed on a side of the first guide wall;

a second control member disposed on a side of the second guide wall; and a connection device connected to the first control member and the second control member, wherein the control mechanism is configured such that the connection device transmits a drive force between the first control member and the second control member, and each of the first and second control members is configured to move between a holding position in which the photosensitive member unit is allowed to move between the first position and the second position and a release position in which the photosensitive member unit is allowed to move between the second position and the third position.

* * * * *